United States Patent [19]

Shirley

[11] 4,394,881

[45] Jul. 26, 1983

[54] DRILL STEERING APPARATUS

[76] Inventor: Kirk R. Shirley, 15719 Tumbling Rapids, Houston, Tex. 77084

[21] Appl. No.: 158,948

[22] Filed: Jun. 12, 1980

[51] Int. Cl.[3] ..... E21B 7/08

[52] U.S. Cl. ..... 175/76; 166/319

[58] Field of Search ..... 175/76, 73; 166/332, 166/319; 251/319, 318

[56] References Cited

U.S. PATENT DOCUMENTS

| | | | |
|---|---|---|---|
| 3,092,188 | 6/1963 | Farris et al. | 175/76 |
| 3,424,256 | 1/1969 | Jeter et al. | 175/76 |
| 3,593,810 | 7/1971 | Fields | 175/76 |
| 3,595,326 | 7/1971 | Claycomb | 175/73 |

*Primary Examiner*—James A. Leppink

*Assistant Examiner*—Thuy M. Bui

*Attorney, Agent, or Firm*—Bernard Kriegel

[57] ABSTRACT

Well bore drilling apparatus has a steering tool operable to stabilize the drill string above the drill bit and to selectively cause a lateral force to be applied to the bit to deflect the drill in a selected direction. The apparatus includes master sensors, in the form of pistons, which sense the lateral force of the drill stem on the low side of the hole and apply fluid pressure to selected slave pistons which are circumferentially spaced above the drill bit to apply lateral thrust in the selected direction. The slave pistons are selected by valves in the apparatus which are opened or closed, as desired, either before running the tool into the well bore or by a wireline manipulator tool while the tool remains in the well bore.

27 Claims, 29 Drawing Figures

P
17
2
2
S1
20
18
11
T
73
17
3
3
20
S2
H
18
B
10

20
23
19
MP
11
S1
1
W
P2
2
P1
21

F
P6
11
SP
6
5
7
P5
P7
20
S2
8
21
19
23
P8

~M~
11
43b
63
62
30
14
14
17
31
19
60
15
15
52
53
56
P7
54
20
51
23
52
50
58
53
52
31
30
18
11
13
14
B

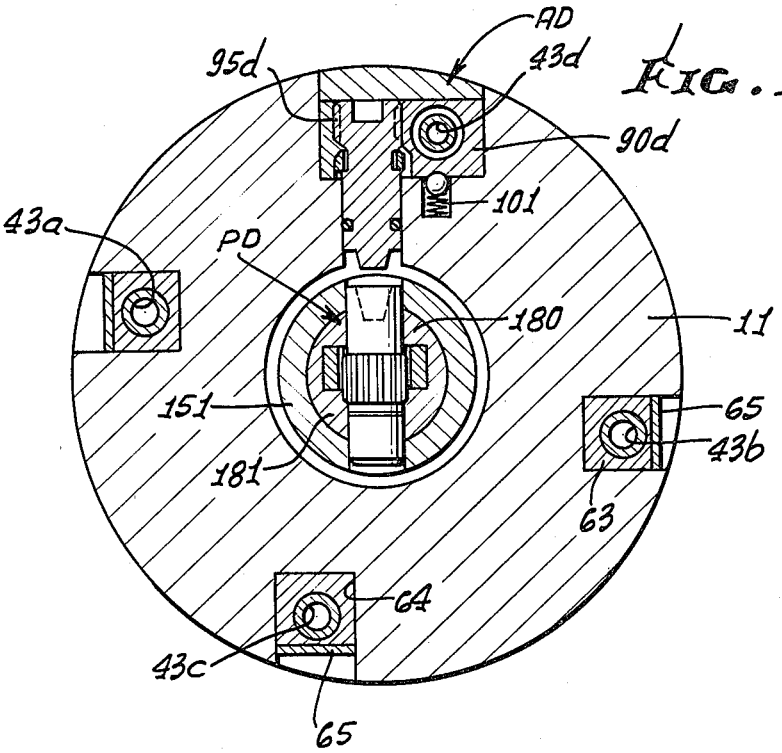
FIG. 12.
FIG. 14.
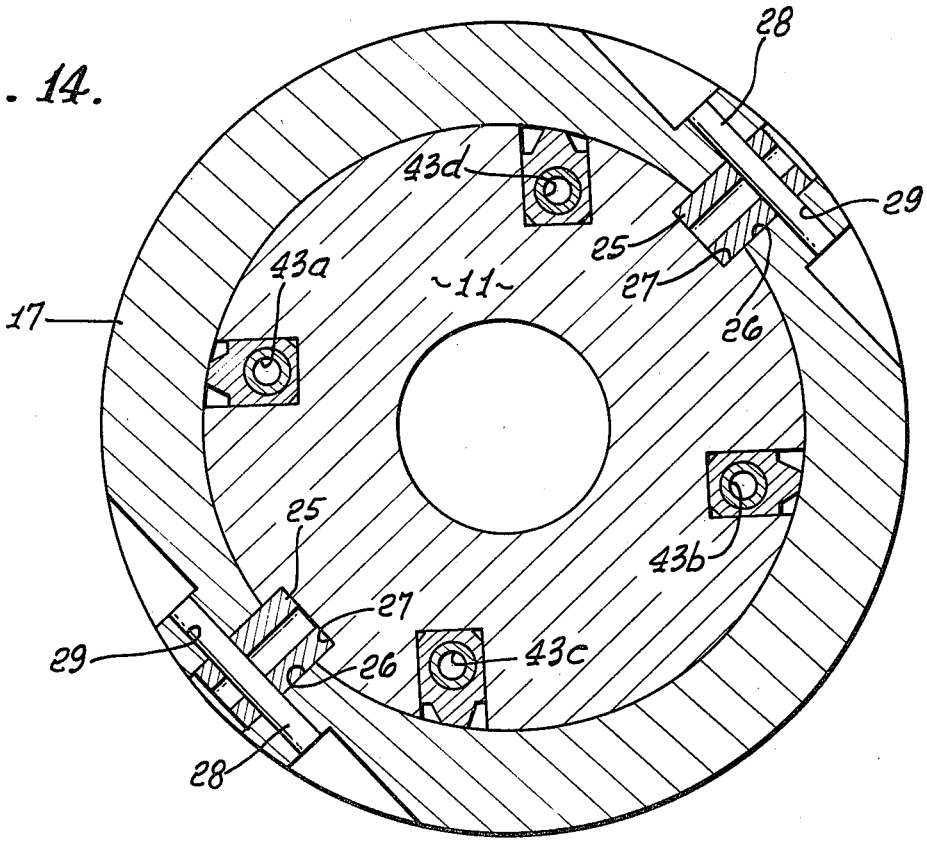

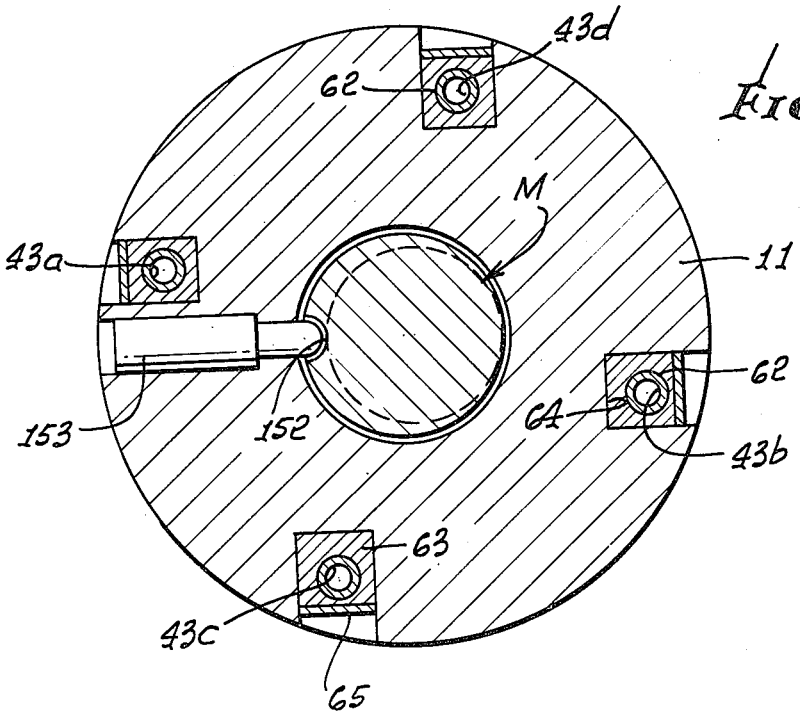
FIG. 13.
FIG. 15.
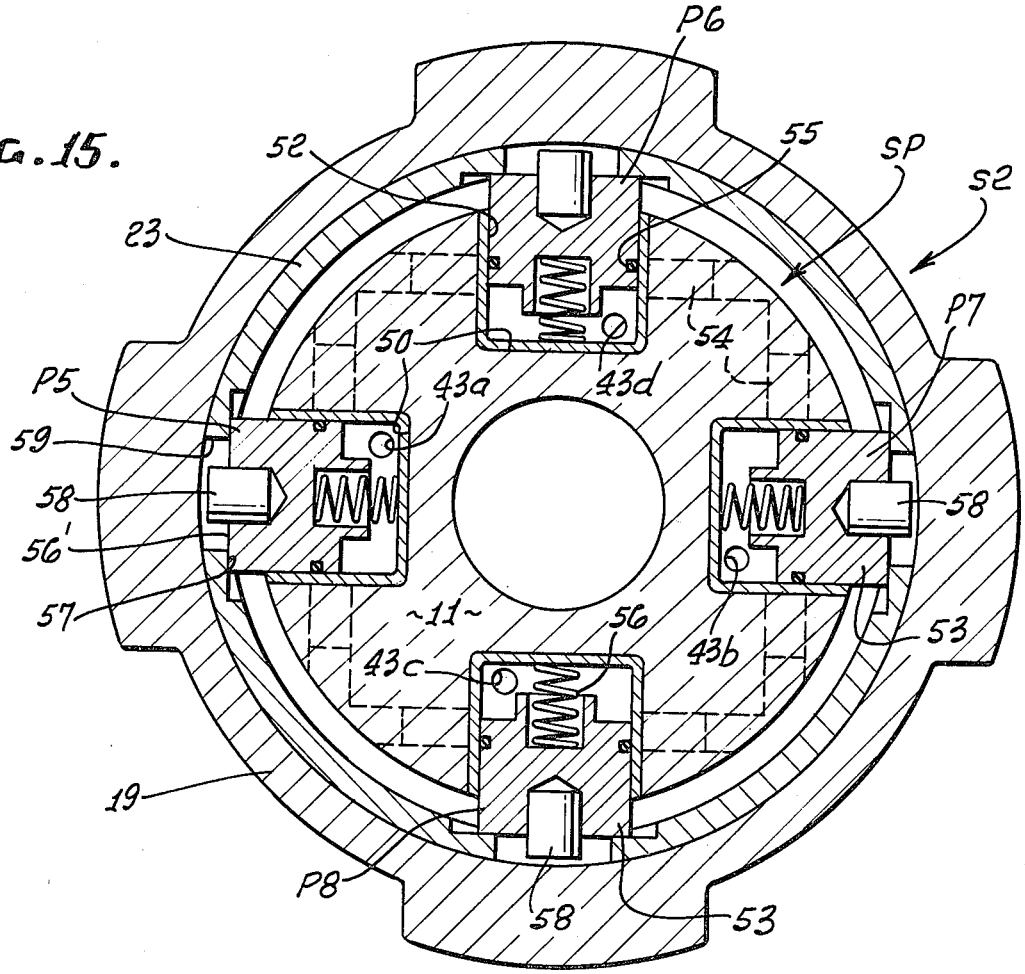

DRILL STEERING APPARATUS

BACKGROUND OF THE INVENTION

In the drilling of wells, such as oil or gas wells, into or through earth formation, by means of the usual "rotary" drilling methods, it sometimes becomes desirable or necessary to control or change the direction in which the well bore is progressing. Changes in angle from the vertical or azimuthal changes are often necessary. Therefore, various directional drilling tools and procedures have evolved.

At a given depth in the earth, it is frequently desired that the drill string be "kicked off" to establish a desired direction for the well, as it is being drilled. In other cases, the well may progress in an undesired direction, say, off vertical in which case it is desired to return the drill to the desired direction.

Directional drilling has involved the use of various "kick-off" or angle changing tools adapted to apply a lateral thrust on the drill, close to the drill bit. Well drilling strings are typically made up of a drill collar string above the bit, to which lengths of drill pipe are added, as the drilling progresses, for conducting well drilling fluid from the drilling rig to the drill bit, to flush cuttings from the well bore, upwardly through the annular space outside the drill string. The drill collars tend to rest on the low side of the hole during rotation, and since such drill collars are heavy, substantial force is applied laterally, this force being useful in providing a counter-force which can be employed in changing the direction in which the well drilling operation progresses. A directional tool which utilizes the lateral force of the drill collars to change direction is shown and described in Jeter et al. U.S. Pat. No. 3,424,256 and Farris U.S. Pat. No. 3,092,188.

An important factor in well drilling economics is the possibility of taking corrective measures, such as directional changes, without round tripping the drill string, i.e., pulling the entire drill pipe and drill collar string from the hole, either to install or adjust a directional or kick-off tool. On the other hand, the retrieval of the usual rotary drilling string to run a directional in-hole motor with a bent sub installed above the bit is also an expensive but much used and effective procedure. Likewise the running of a special jet bit to erode an opening in the earth into which the drill bit passes is an expensive, time consuming operation.

In directionally drilled wells, a target many thousands of feet in depth may be established, wherein the bit must be held within the target area which may have a small radius, say 20 to 250 feet. However, the drill bit tends to be forced off the preplanned direction or angle by changes in the formation angle or hardness and by the application of excessive drilling weight. Thus, directional changes become generally necessary.

The prior art devices referred to above, and in general use, are all costly, since round tripping of the drill string to change or adjust equipment involves considerable time, as well as costly equipment.

SUMMARY OF THE INVENTION

The present invention provides a directional drilling tool, adapted to be installed in the drill collar string above a rotary drill bit to control direction of the drilling activity in response to the lateral thrust of the drill collars on the low side of the well bore, in an improved and more economic manner.

The present invention provides a bit steering or directional drilling device which is so constructed as to inhibit bit deflection from a pre-determined path. Or the steering device can be employed to force the bit into a different, planned drilling path. When not used to maintain angle from vertical or establish a new angle, the steering device is useful in a straight hole drilling hook up to stabilize the drill collars.

More particularly, the invention provides a bit steering structure in which upper and lower circumferentially spaced pistons are provided within stabilizer rings on the tool body. The upper pistons effect hydraulic pressurization of the lower pistons in a manner determined by selective valves in the internal fluid system. The valves can be selectively opened and closed either manually, when installing the steering tool in the drill string, or, by suitable means operable at the drilling rig, to change the hydraulic thrust relationship of the upper, master pistons and the lower, slave pistons, whereby to vary the direction of lateral thrust on the drill bit.

As specifically shown herein, the selective valves can be actuated to desired open or closed conditions by a manipulator tool which can be dressed on the rig and lowered and retrieved on a wireline, to engage selected valves and shift them to open or closed conditions, to determine different thrust directions of the lower slave pistons, in response to lateral thrust applied to the upper, master pistons, as the assembly rotates in engagement with the low side of the hole.

By virtue of the fact that the steering devices can be controlled or changed remotely from the rig floor, round tripping of the drill string is minimized in directional drilling operations, and when a desired angle and direction are established, the steering tool can be remotely neutralized for continued straight drilling, without requiring that the tool be pulled from the well bore.

In its preferred form illustrated herein, a plurality of radially expansible and retractable steering pistons are disposed within a well bore engaging stabilizer ring, the pistons being circumferentially spaced. In the illustrated form, four pistons are spaced angularly 90°, and under the influence of a number of pressurizing pistons adjacent the top of the tool, the steering pistons are selectively forced outwardly to apply a deflecting force against the stabilizer and the wall of the bore hole, causing a reaction force urging the bit against the other side of the bore hole. The selective valve system which determines which steering piston or pistons are operative enables the tool to be preset at the surface, or changed in the hole, to nine drilling attitudes.

A neutral condition, with all pistons idle, establishes a straight hole drilling condition, with the drill bit stabilized by the lower stabilizer and the upper end of the tool stabilized by the upper stabilizer, as the drilling progresses. With the four steering pistons eight different steering directions can be established, by selectively causing, in response to conditioning the selector valves, expansion of a selected piston or a selected pair of pistons. The reference is the low side of the hole, so that the tool is not dependent upon directional survey instruments or bent subs at the commencement of drilling operations.

The essence of the invention is the ability of the tool to be selectively adjusted to establish the straight hole mode of drilling or the multiple modes of operation which enable angle from vertical and direction to be established with reference to the low side of the bore hole.

This invention possesses many other advantages and has other purposes which may be made more clearly apparent from a consideration of a form embodying the invention. This form is shown and described in the present specification and in the drawings accompanying and constituting a part thereof. It will now be described in detail, for the purpose of illustrating the general principles of the invention; but it is to be understood that such detailed description is not to be taken in a limiting sense.

Referring to the drawings.

Figure 4A:
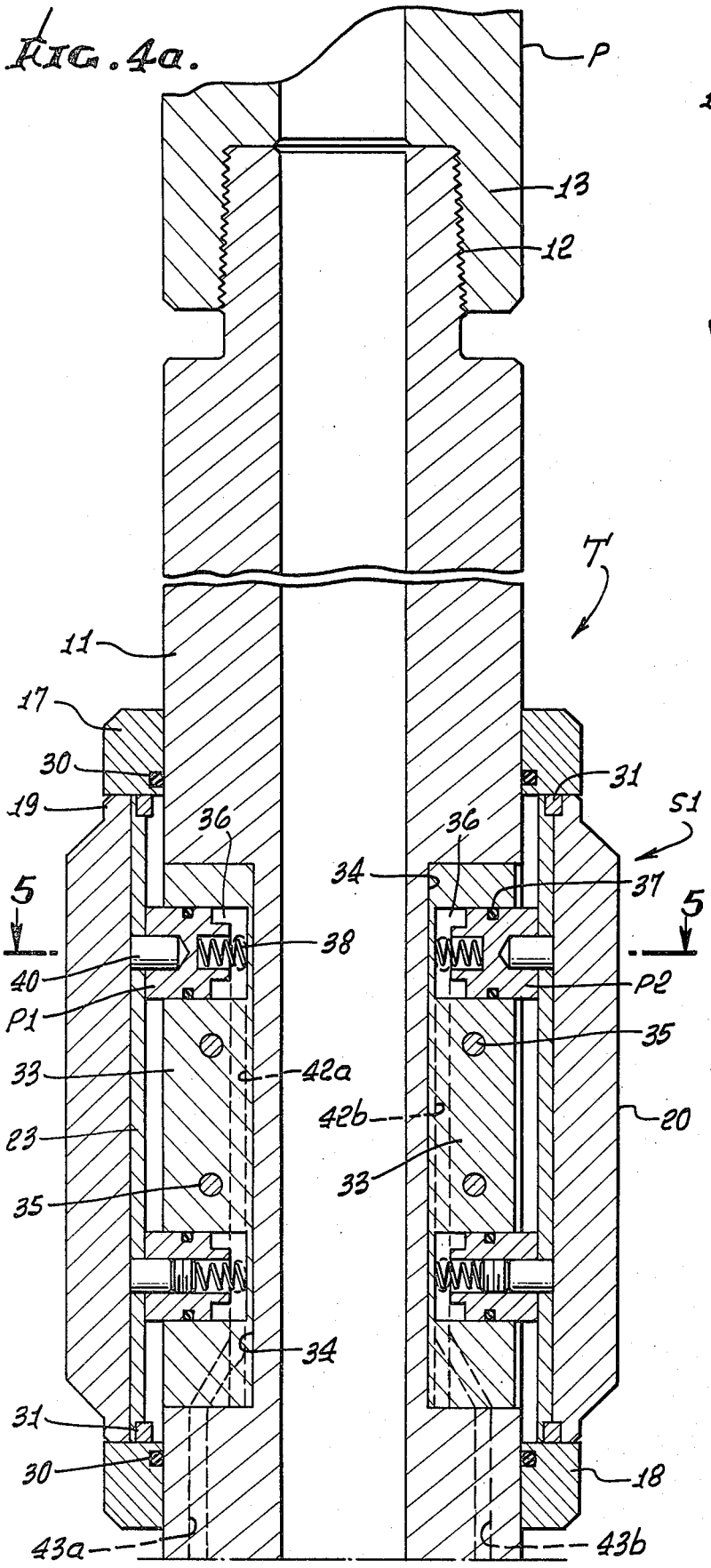
Figure 5:
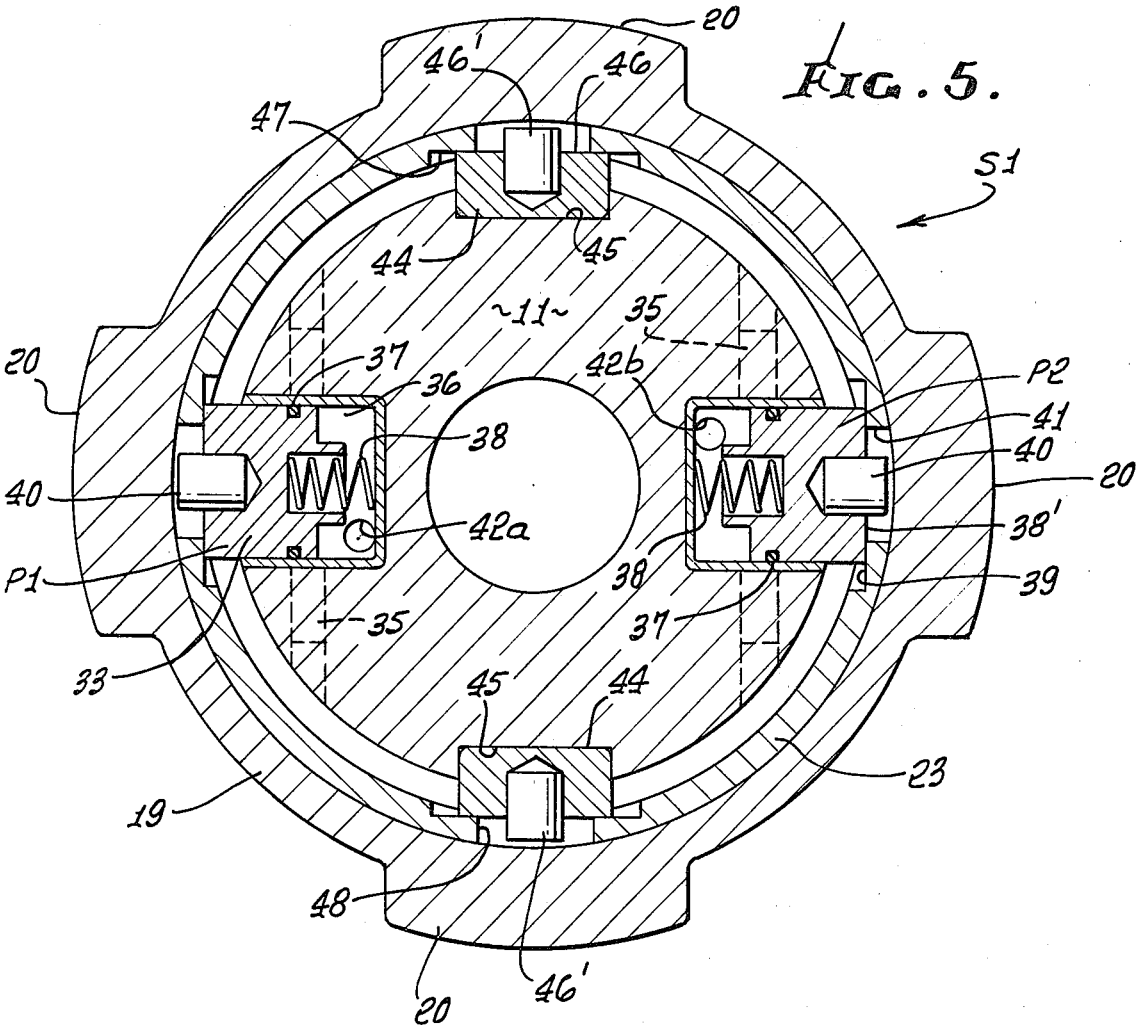

FIGS. 4*a* through 4*f*, together, constitute a longitudinal section, with certain parts shown in elevation and partially broken away, showing the steering tool, on an enlarged scale, and showing a manipulator tool seated in the steering tool;

FIG. 5 is an enlarged transverse section on the line 5—5 of FIG. 4*a;*

Figure 4B:
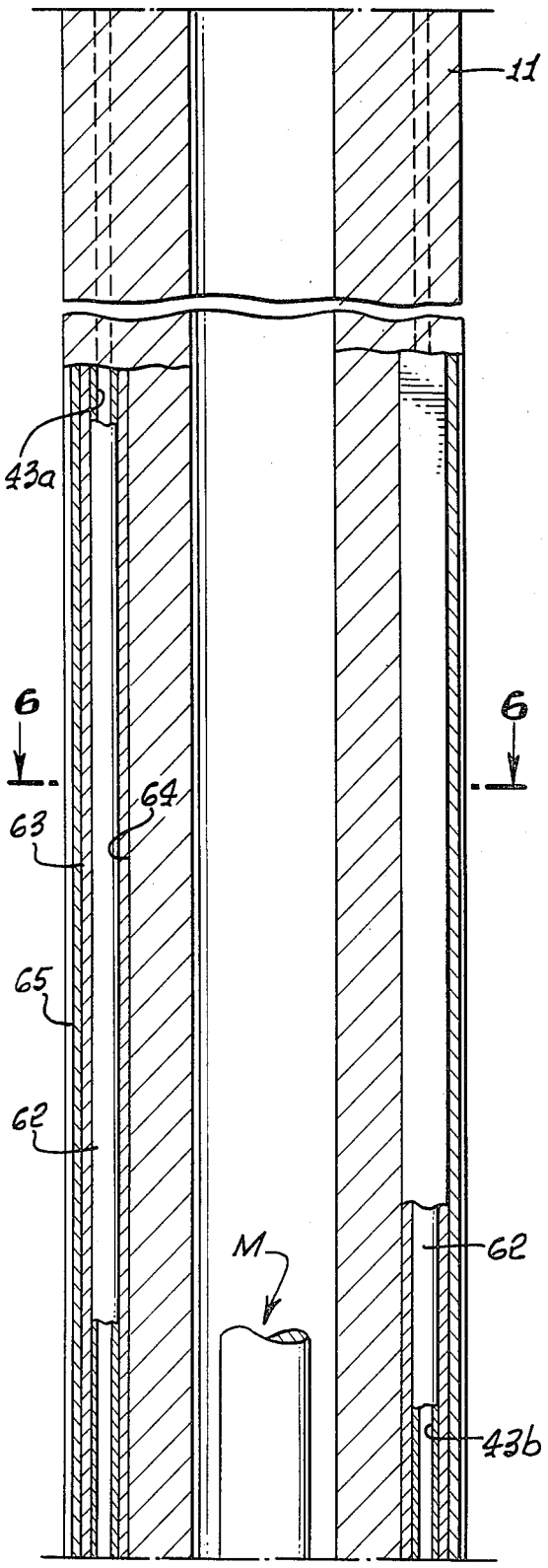
Figure 6:
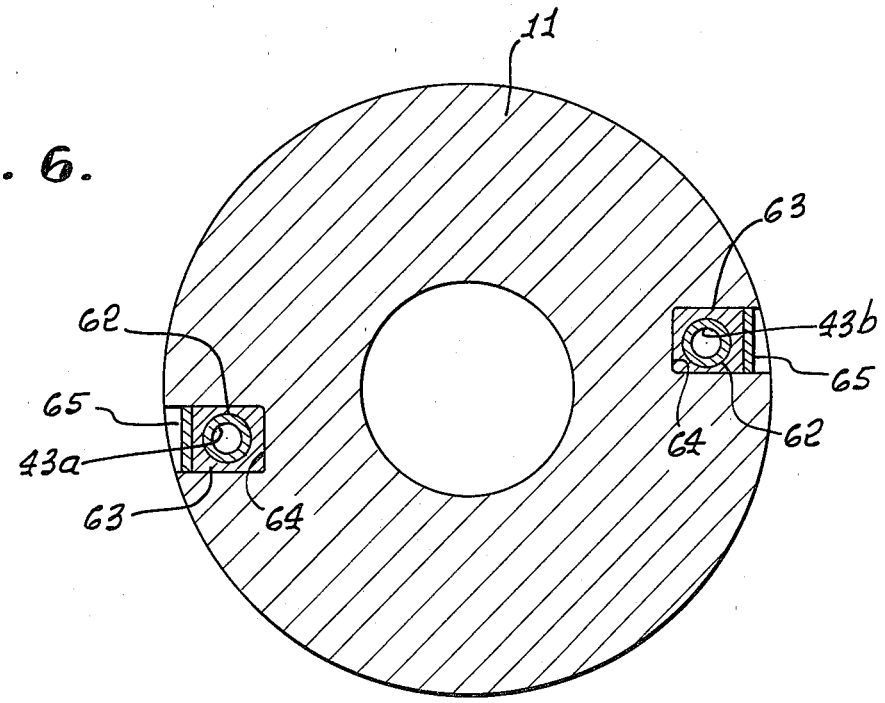

FIG. 6 is an enlarged transverse section on the line 6—6 of FIG. 4*b;*

Figure 4C:
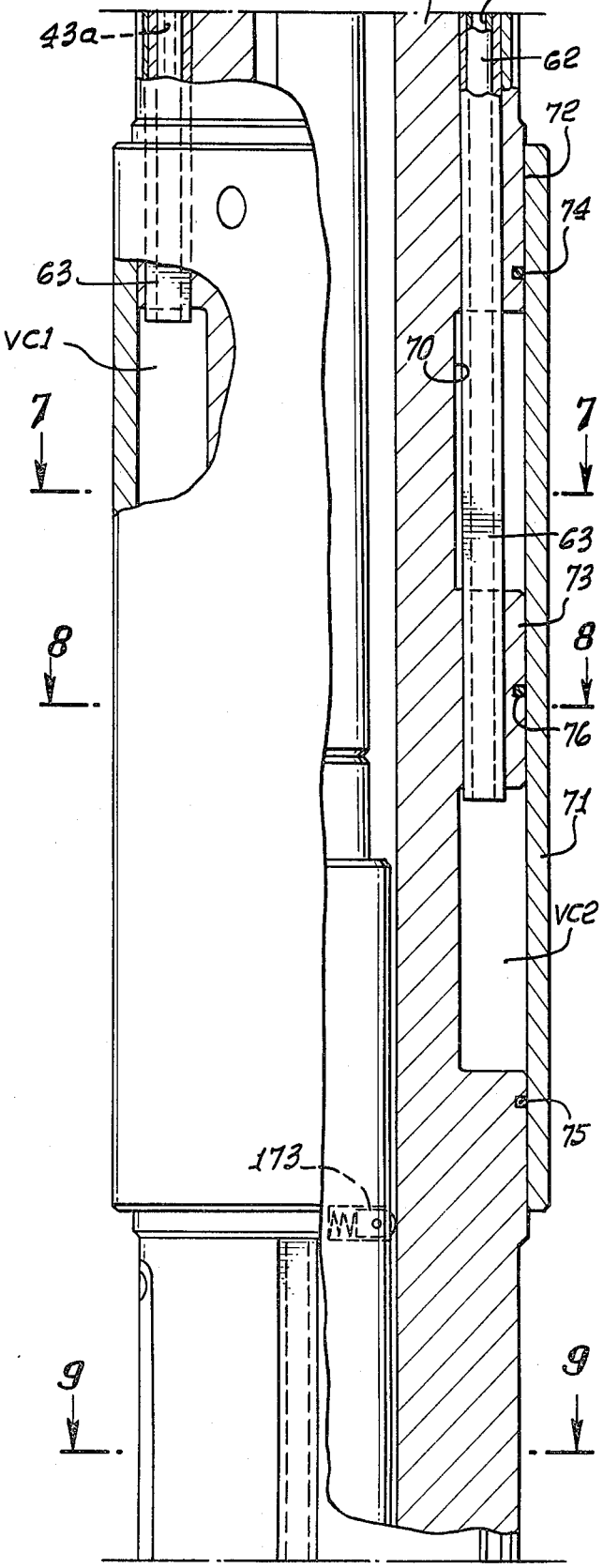
Figure 7:
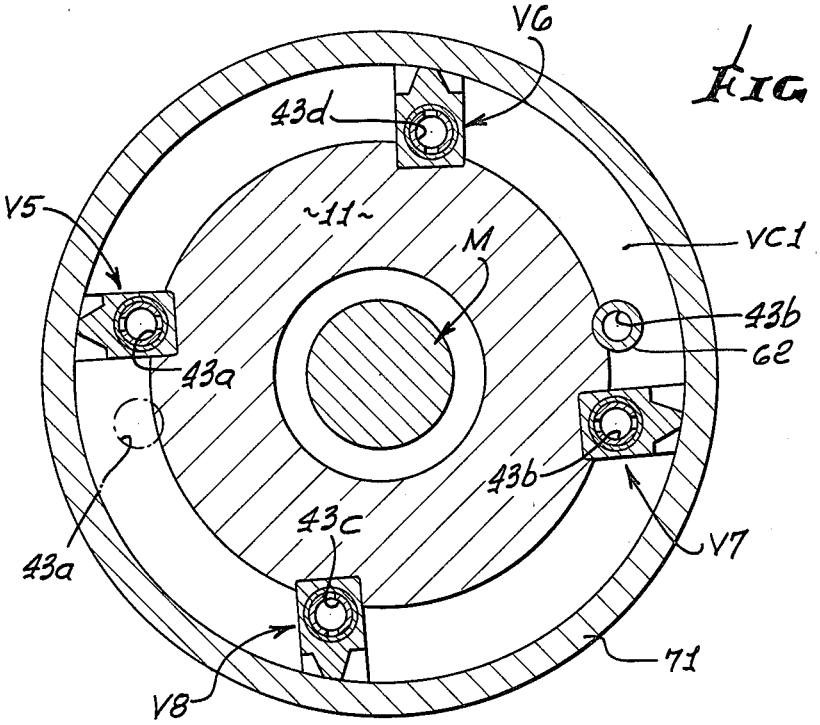

FIG. 7 is an enlarged transverse section on the line 7—7 of FIG. 4*c;*

Figure 8:
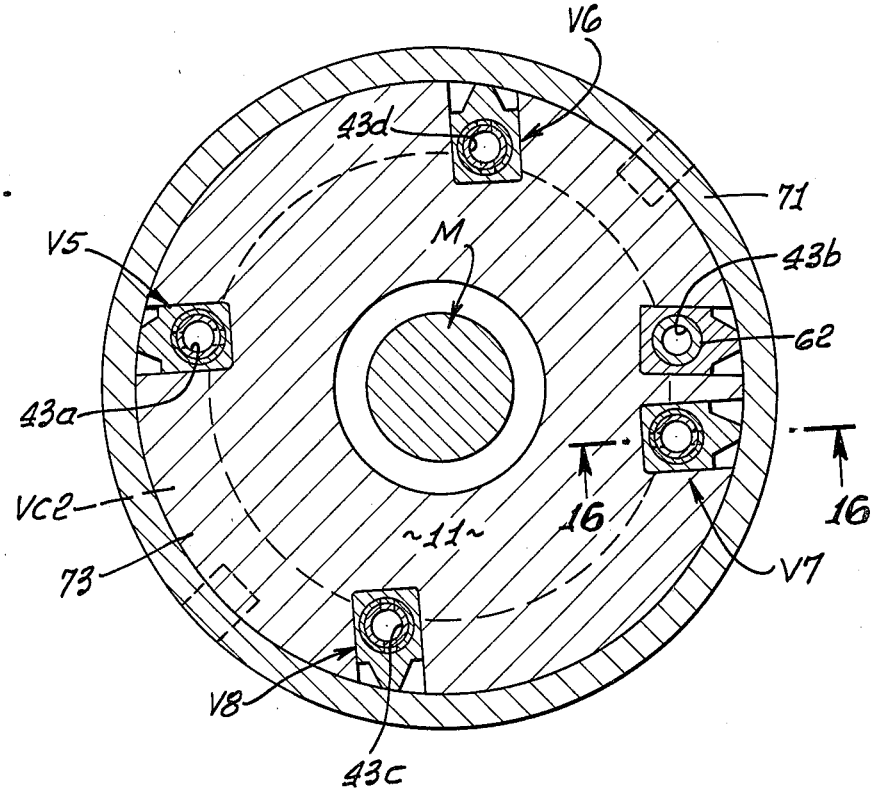

FIG. 8 is an enlarged transverse section on the line 8—8 of FIG. 4*c;*

Figure 9:
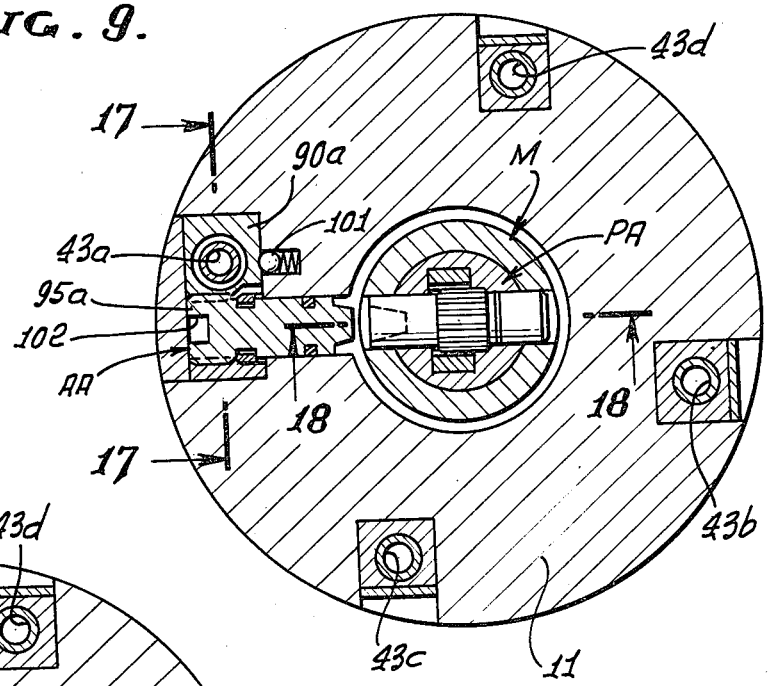

FIG. 9 is an enlarged transverse section on the line 9—9 of FIG. 4*c;*

Figure 4D:
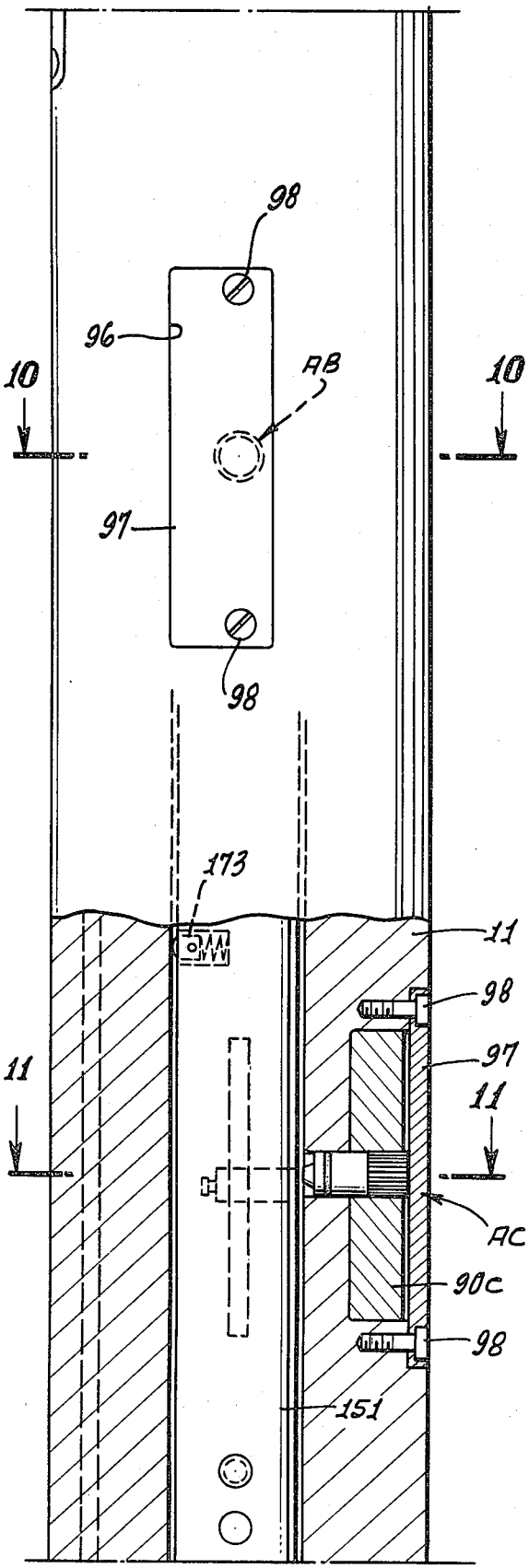
Figure 10:
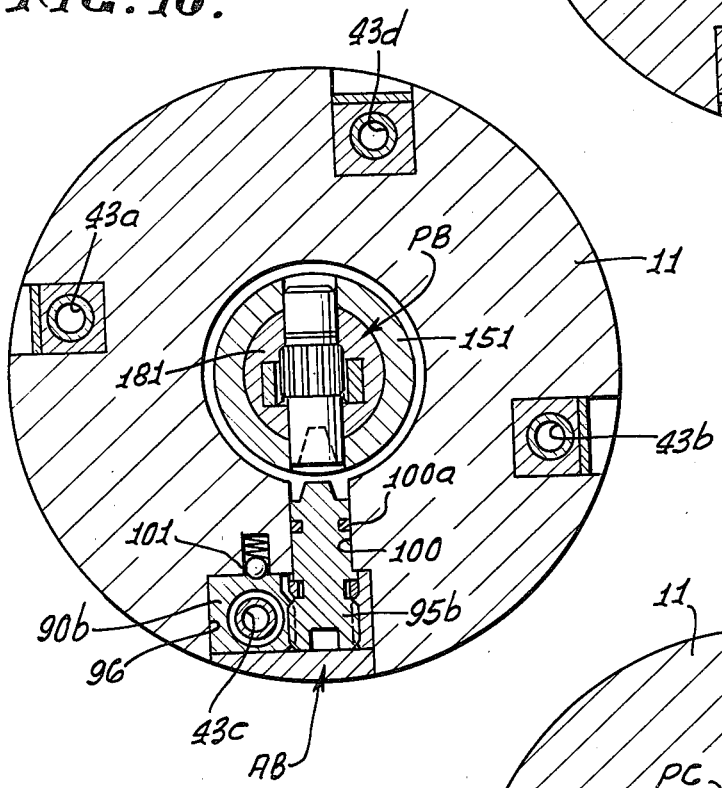

FIG. 10 is an enlarged transverse section on the line 10—10 of FIG. 4*d;*

Figure 11:
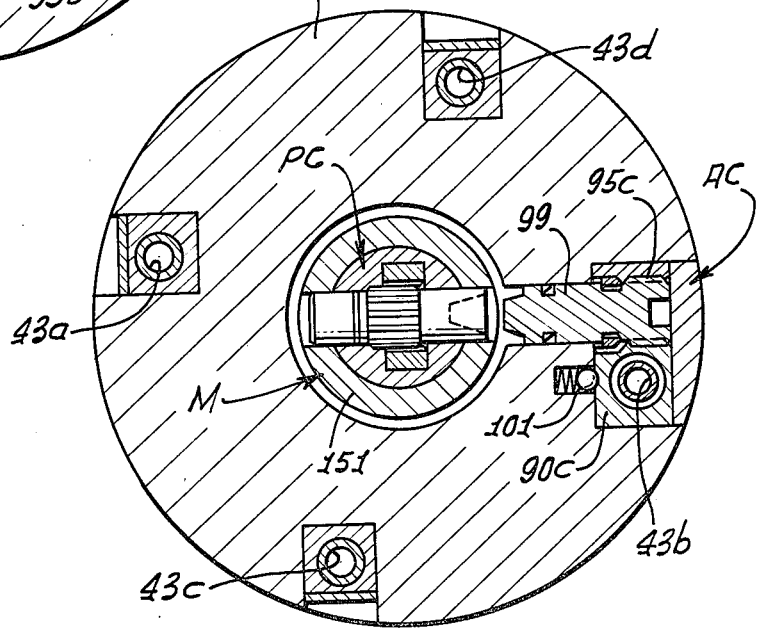

FIG. 11 is an enlarged transverse section on the line 11—11 of FIG. 4*d;*

Figure 4E:
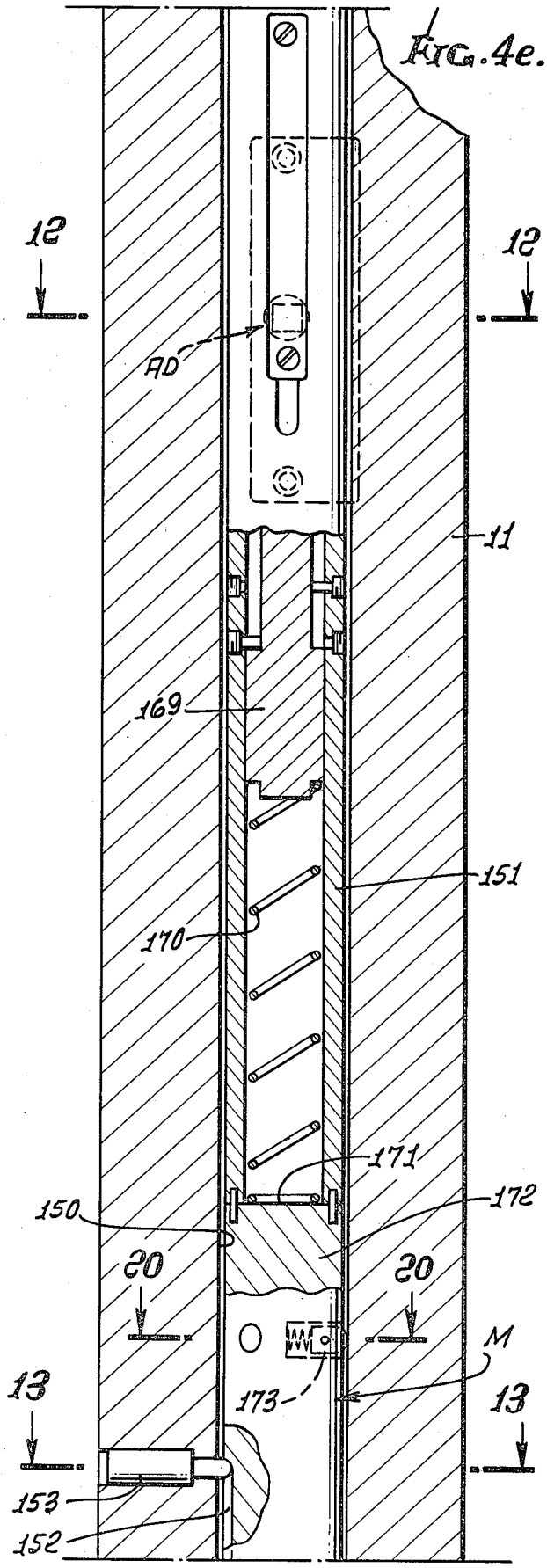

FIG. 12 is an enlarged transverse section on the line 12—12 of FIG. 4*e;*

FIG. 13 is an enlarged transverse section on the line 13—13 of FIG. 4*e;*

Figure 4F:
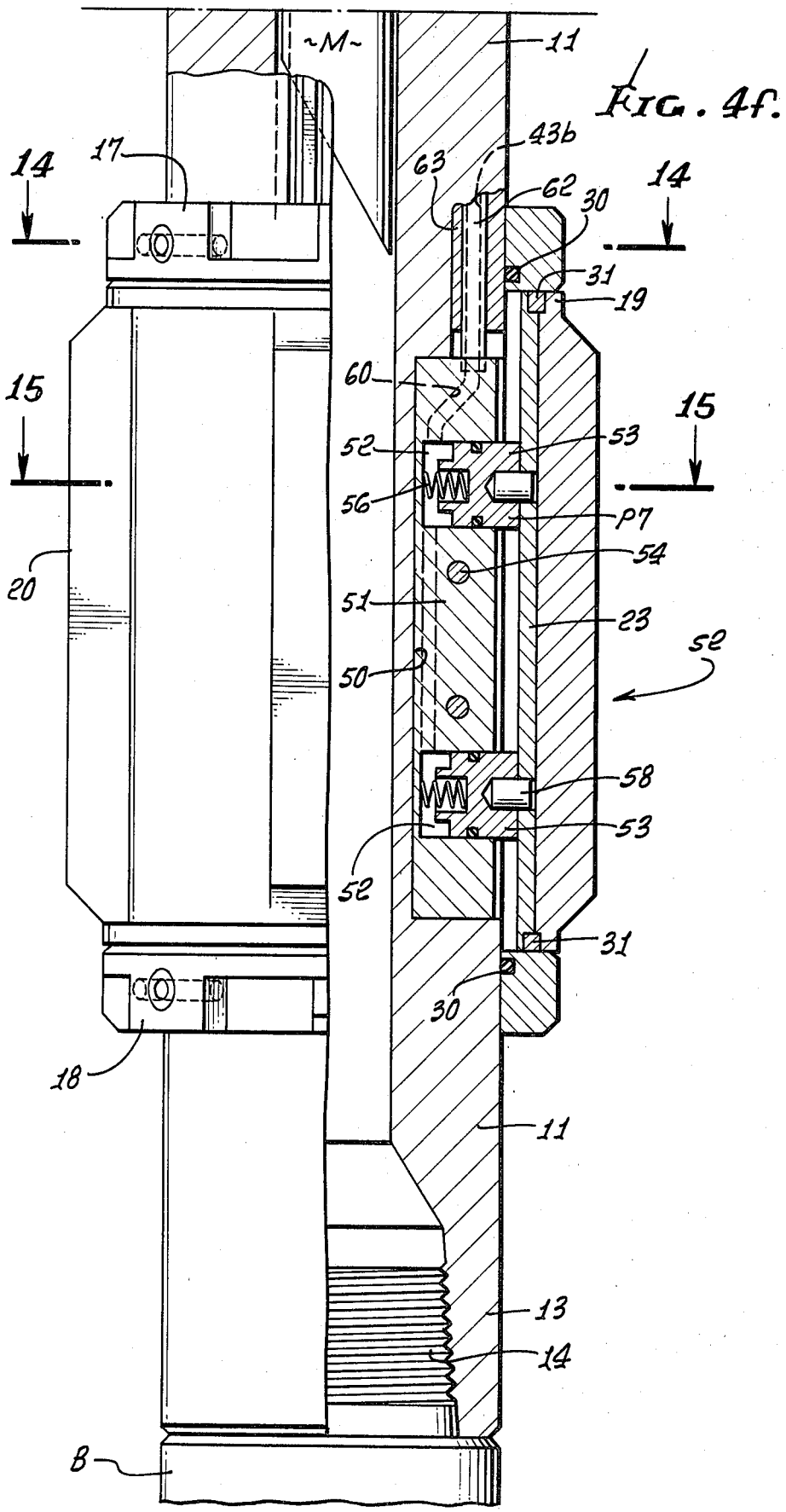

FIG. 14 is an enlarged transverse section on the line 14—14 of FIG. 4*f;*

FIG. 15 is an enlarged transverse section on the line 15—15 of FIG. 4*f;*

Figure 16:
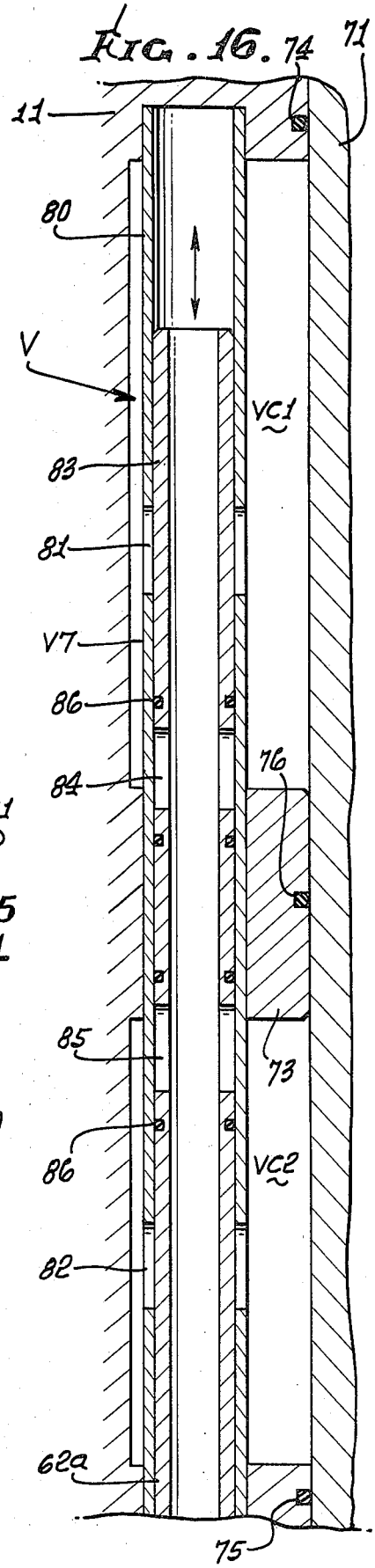
Figure 17:
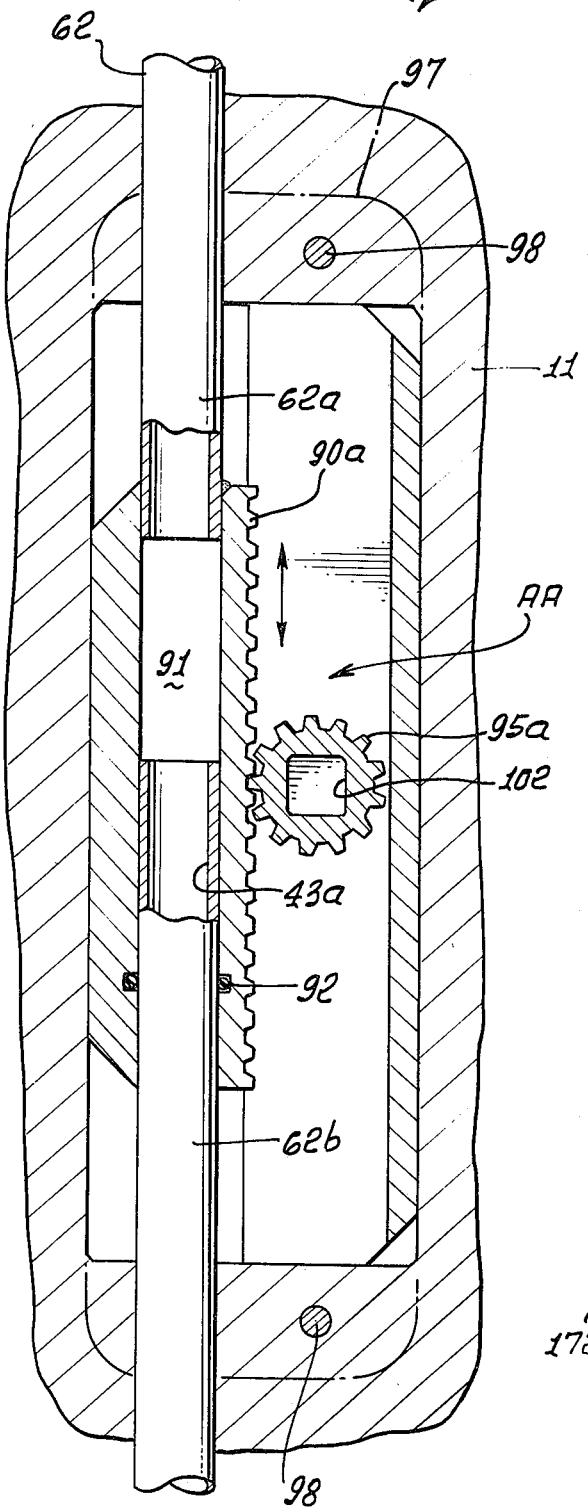
Figure 19:
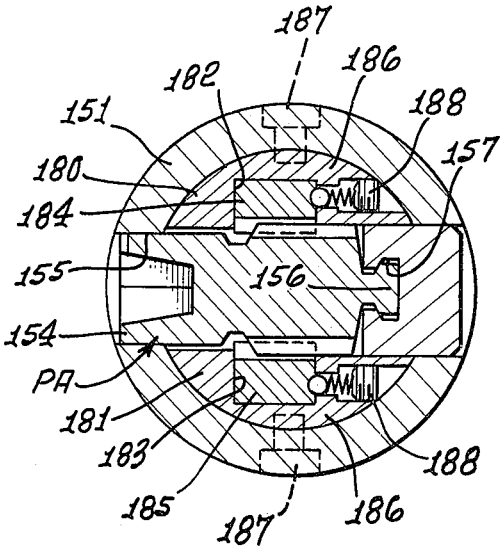
Figure 20:
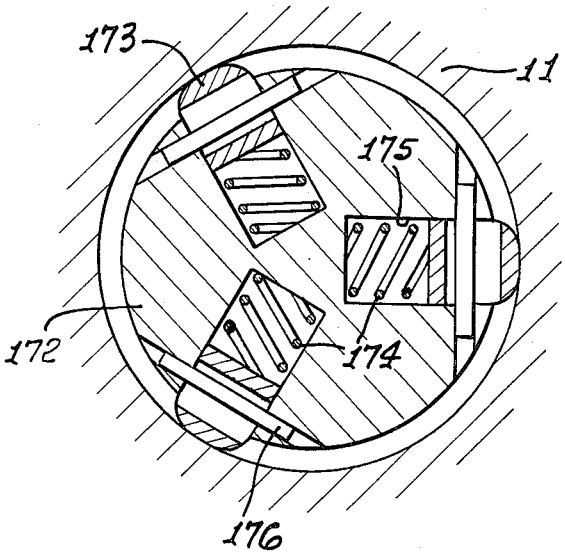
Figure 18A:
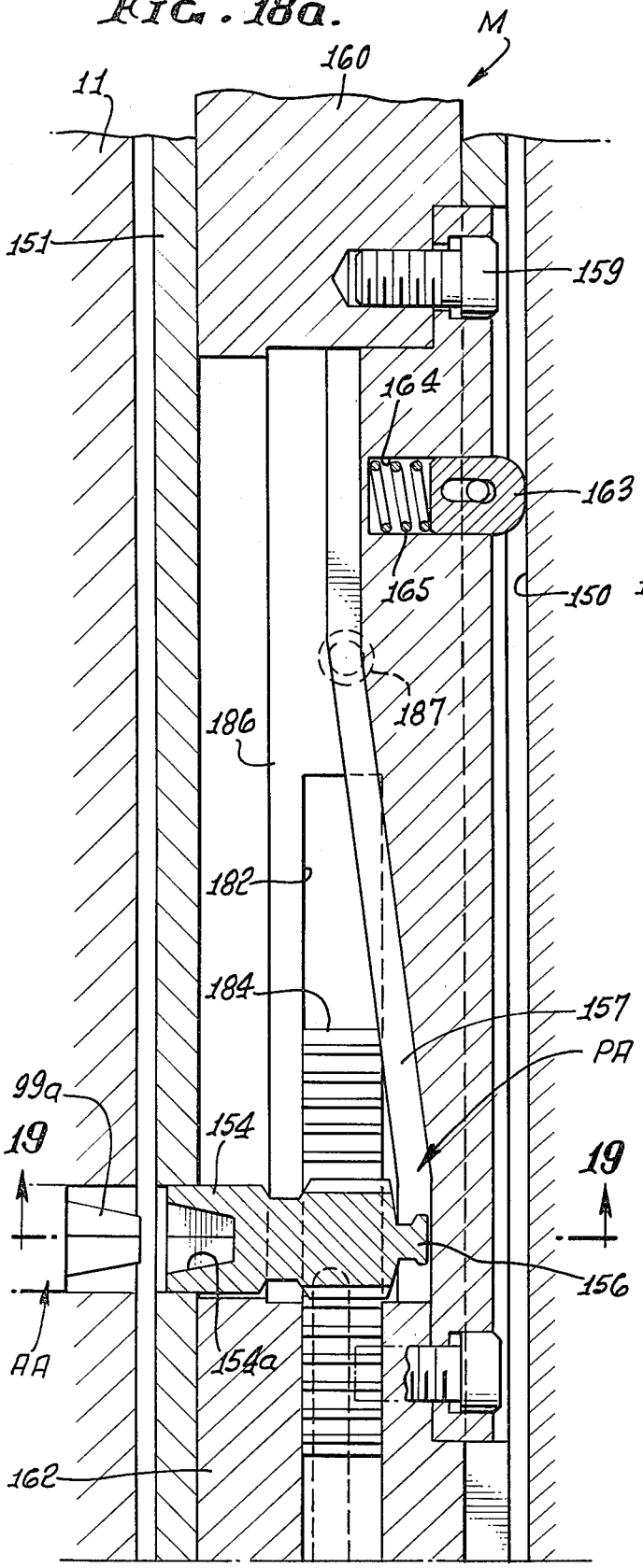
Figure 18B:
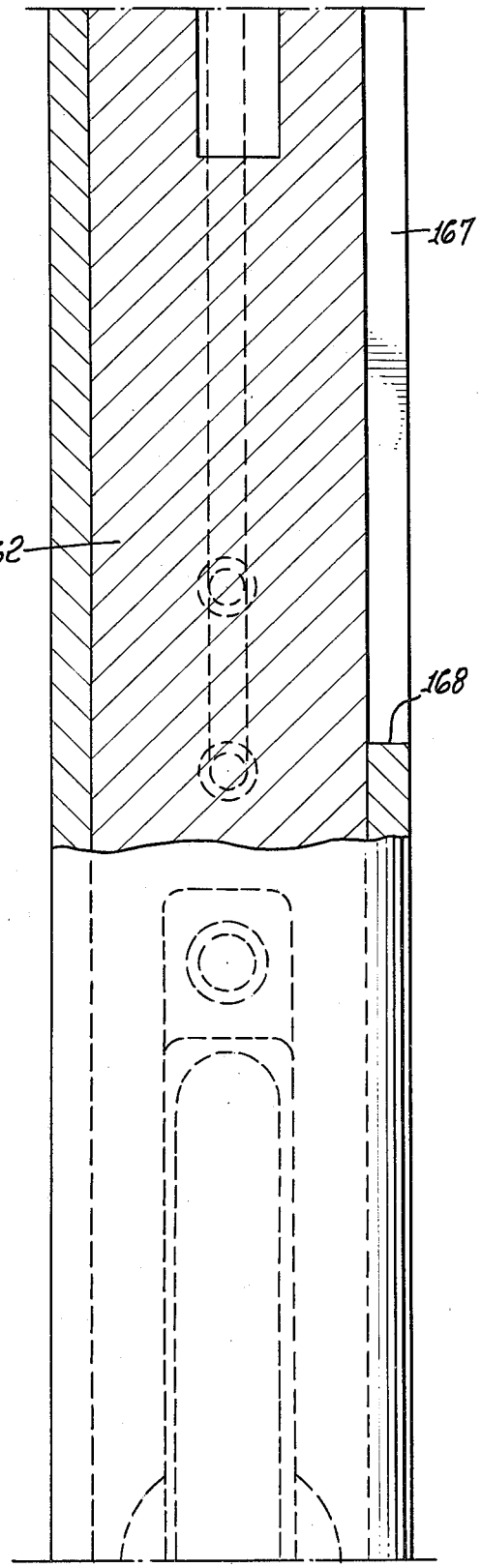

FIG. 16 is a representative longitudinal section through a valve, as taken on the line 16—16 of FIG. 8;

FIG. 17 is a representative longitudinal section through a valve and valve shifter, as taken on the line 17—17 of FIG. 9;

FIGS. 18*a* through 18*d*, together, constitute a longitudinal section with certain parts shown in elevation and broken away, as taken on the line 18—18 of FIG. 9, showing the details of the manipulator tool;

FIG. 19 is a transverse section, as taken on the line 19—19 of FIG. 18*a*, showing a representative valve actuator;

FIG. 20 is an enlarged transverse section on the line 20—20 of FIG. 4*e;*

Figure 21:
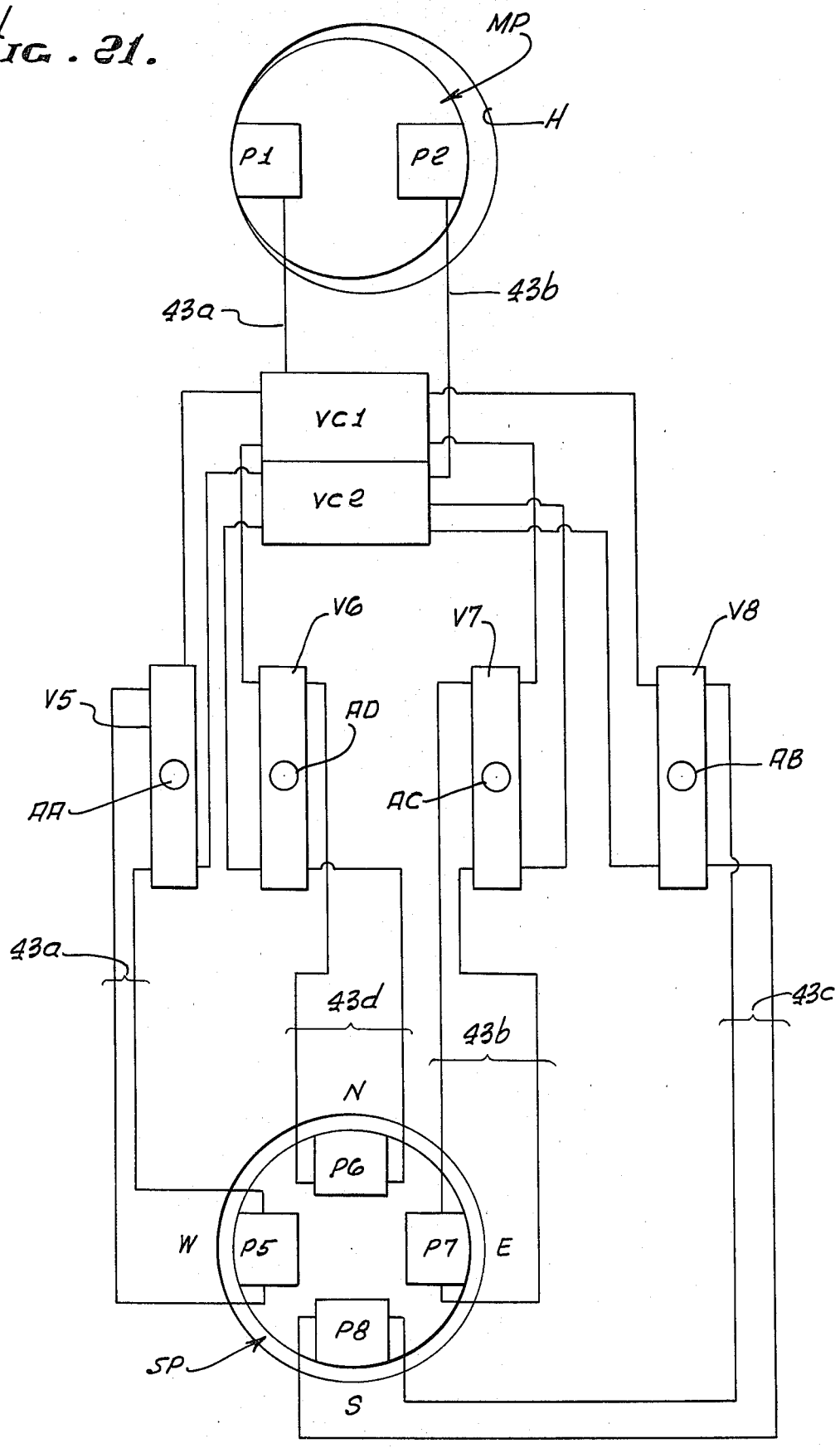

FIG. 21 is a schematic diagram illustrating the selective operating modes of the steering tool.

As seen in the drawings, a steering tool T is installed in a rotary well drilling pipe string P. Rotary bit B has roller cutters 10 to drill a bore hole H, in response to rotation of the drill string, as drilling fluid is circulated downwardly through the drill string and the steering tool, exiting from the bit and returning to the top of the bore hole through the annular space between the wall of the bore hole and the drill pipe string.

As is well known, and as disclosed in the above-identified prior art, well bores can be deviated from the vertical by causing a lateral force on the bit as the drilling progresses. Likewise, a crooked or deviated bore hole can be straightened by applying lateral force to the bit as the drilling progresses. Also, a bore hole can be drilled generally straight if the drill string or drill collars are stabilized close to the bit so that weight on the bit does not cause bending of the drill collars or drill string in the region close to the bit. To stabilize the drill string and drill collars in the bore hole, it is a practice that a number of stabilizers may be mounted on the drill string, one stabilizer close to the bit, and one or more other stabilizers spaced upwardly at intervals calculated to inhibit undesired angle as the bore hole progresses.

In the case of the present invention, a pair of stabilizers S1 and S2 are mounted on the drill string, in longitudinally spaced relation on the body of a steering tool T, at a location spaced upwardly from the bit and at a location close to the bit. These stabilizers are incorporated in the tool T and are adapted to either stabilize the drill string for straight hole drilling, or to cause the application of a lateral force on the bit, by applying a lateral thrust against the bore hole wall in a selected direction. As will be later described, the direction of lateral thrust cannot only be selected, but changed, without removing the tool from the hole. The direction of lateral thrust applied to the bit is with reference to the low side of the hole, since the drill string and tool T rests upon the low side of the hole during the drilling operations.

The tool, as will be apparent from the following description, is not dependent upon orienting aids at the outset, such as the use of time consuming and expensive directional survey instruments, bent subs, or so-called mule shoes. When the present steering device is located at the bottom of the hole, it is automatically oriented with respect to the low side of the bore hole. The direction of the lateral force applied to the bit may be predetermined by setting the tool at the surface for one of a plurality of drilling attitudes. The tool, as will be later described, is adapted to be dressed for nine drilling attitudes. The neutral position of the tool enables the stabilizers S1 and S2 to maintain a straight hole drilling attitude, by tending to stabilize the pipe or drill collar string centrally in the bore hole, so that the bit can follow a straight course. The eight angular attitudes which can be accomplished by the tool can cause the bit to deviate from a straight path, causing the bit to gain or drop vertical angle, turn right or left, and combine the above to effect bit deflection in 45° vectors. In addition to being susceptible of being set or conditioned at the top of the well, before the tool is run into the well bore, the selected drilling attitudes can be changed while the tool rests at the bottom of the bore hole by means of a wire line manipulator. The use of a wire line manipulator tool to redress or adjust the tool, while the tool remains in the well bore, results in substantial savings, since the number of round trips of the drill pipe is significantly reduced, and the steering tool can be adjusted for straight hole drilling or directional drilling, and vice versa, if necessary.

In brief, the steering tool can be used in normal straight hole drilling or in directional drilling operations without requiring the removal of the straight hole drilling tools from the well bore and the installation of directional tools in the drilling string.

The steering tool T comprises an elongated tool body 11 substantially the same diameter as the drill pipe or drill collar string P. At its upper end, the body 11, as seen in FIG. 4*a*, has a threaded pin end 12 for engagement in the threaded box 13 of the upwardly extended pipe or drill collar string P. At its lower end, as seen in FIG. 4*f*, the body 11 has a threaded box 13 for reception of the threaded pin 14 of the drilling bit B. The stabilizers S1 and S2 are each revolvably supported on the body between a pair of axially spaced stop collars 17 and 18 which are secured on the tool body in a manner to be later described, and each stabilizer comprises a tubular body 19 provided with a suitable number of circumferentially spaced and laterally projecting ribs 20 which extend longitudinally. The upper stabilizer S1, as generally illustrated in FIG. 2, is revolvable on master piston means generally noted at MP, while the lower stabilizer S2 is revolvably mounted upon slave piston means SP.

The master piston means and the slave piston means are generally similar structures, the master piston means being operable in response to the weight of the drill pipe string in the region of the upper stabilizer S1 to transmit pressure to the slave piston means SP, to produce a lateral force on the bit in a direction which can be determined when the steering tool is dressed at the top of the well or which can be modified while the steering tool is in a drilling disposition within the well bore.

Figure 2:
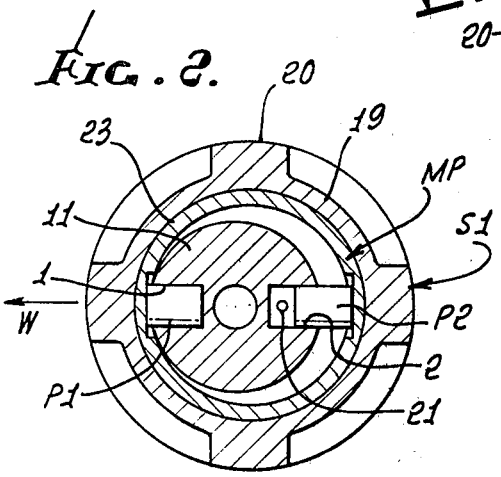
FIG. 2 is a transverse section on the line 2—2 of FIG. 1 through the upper stabilizer.
Figure 3:
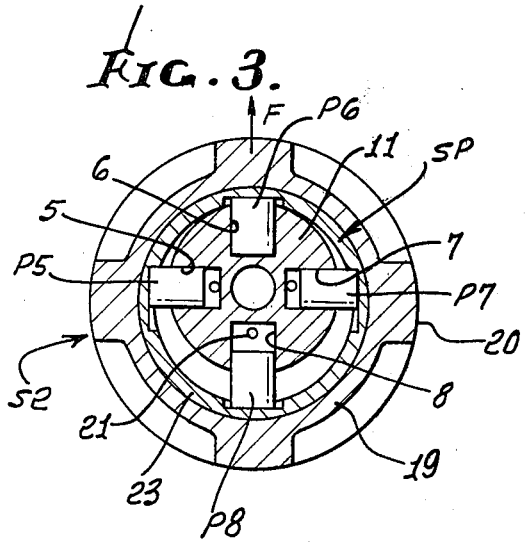
FIG. 3 is a transverse section on the line 3—3 of FIG. 1 through the lower stabilizer.

As generally seen in FIG. 2, the master piston means MP comprises a number of circumferentially spaced radial piston chambers respectively designated 1 and 2, containing pistons P1 and P2. The piston chambers 1 and 2 extend radially and in diametrically spaced relation in the body 11 of the steering tool. Passageways 21, to be later more fully described, extend longitudinally of the tool body and selectively communicate with the slave piston means SP within the stabilizer S2. As seen in FIG. 3, the slave piston means SP, in the illustrative form, like the master piston means MP comprises a plurality of circumferentially spaced piston chambers 5, 6, 7 and 8, having recriprocable therein slave pistons P5, P6, P7 and P8, and it will be seen that the fluid passageways 21, referred to above, open into the piston chambers 5 through 8. The outer ends of the pistons 1 and 2 and 5 through 8 of the master pistons and slave pistons engage with chordal flat surfaces formed within a ring or inner body 23, of the respective piston means, which is revolvably mounted within the respective stabilizer bodies 19, whereby the steering tool body 11, in the region of the master piston and slave piston means, and the sleeve or body section 23 can move relatively laterally, as shown in each of FIGS. 2 and 3. On the other hand, the body section 11 may be centralized within the respective stabilizers S1 and S2, as will be later described.

Figure 1:
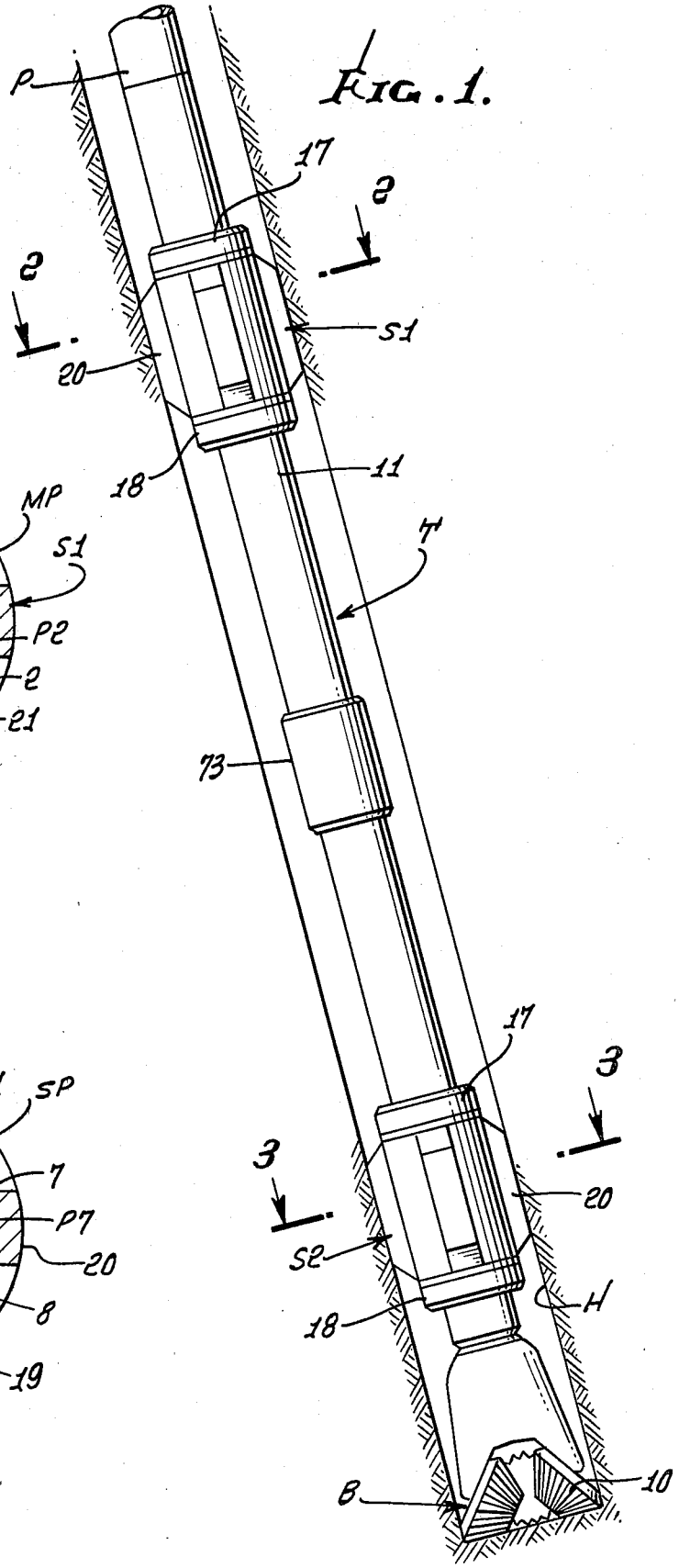
FIG. 1 is a view showing a steering tool embodying the invention in an inclined drilling attitude in a well bore.

As illustrated in FIG. 1, with the stabilizer S1 at an upwardly spaced location from the lower stabilizer S2, and with the bore hole H disposed at an angle, the weight of the pipe string P will rest upon the low side of the hole (in the direction W, as seen in FIG. 2), and by means of the fluid transfer and selector valve system hereinafter to be described, a reactive force (in the direction of the arrow F of FIG. 3) is produced to urge the bit B laterally against the wall of the bore hole.

Referring to FIGS. 4*a*, 4*f*, 14 and 15, as well as to the cross section of FIG. 5, the structure of the respective stabilizers S1 and S2 is shown in greater detail. The stabilizer bodies 19 and the inner sleeve 23 of the master and slave piston means are confined against axial movement between the upper and lower stop collars 17 and 18, previously referred to, which are, as seen in FIG. 14, retained in place upon the tool body 11 by suitable means such as a pair of diametrically spaced roll pins or other keys 25 which extend through radial drilled holes 26 in the respective stop collars into recesses 27 in the steering tool body 11. The roll pins 25 are retained in place by chordal pins 28 which extend through a drilled hole 29 in the stop collar and through the roll pin, at each side of the assembly. Between each stop collar 17 and 18 and the outer periphery of the body 11, is a suitable side ring seal 30, and between the ends of the stabilizer body and the opposing faces of the stop collars are second seals 31 which serve to prevent intrusion of the erosive drilling fluid into the master and slave piston assemblies.

Referring to FIGS. 4*a* and 5, the master piston means is shown as including a pair of elongated piston or cylinder blocks 33 recessed in elongated grooves 34 formed in diametrically opposed relation in the tool body 11. These piston or cylinder blocks 33 are retained in place by roll pins 35 or other fastening means which extend chordally through the body and through the mid-sections of the blocks 33. Each block 33 has a pair of longitudinally spaced, laterally opening piston chambers 36 which reciprocably receive a pair of co-operative master pistons P1 and P2. Each of the pistons P1 and P2 has a side ring or piston ring seal 37 slidably and sealingly engaging the cylindrical wall of a piston chamber 36, and each piston is biased outwardly with respect to the piston chamber by a coiled spring 38 acting against the bottom of the piston chamber. The outer face 38' of each piston is flat and engages a chordal, flat seating surface 39 provided within the sleeve 23. The outer end of each piston is also provided with a pin 40 which projects outwardly into a circumferentially extended notch or slot 41 in the sleeve 23. Each piston block 33 is drilled or otherwise provided with an elongated fluid passage 42*a* or 42*b* leading from the upper piston chamber 36 to the lower piston chamber 36, and thence from the lower end of the piston block, for communication with elongated passages 43*a* and 43*b* which extend downwardly in the body 11, as will be later described.

While more than a pair of diametrically opposed master pistons may be employed in the structure, the embodiment illustrated herein employs only the diametrically opposed pairs of coacting master pistons, and for stability, the body 11 of the tool is also provided with what may be characterised as dummy pistons 44 disposed in seats 45 formed in the body in diametrically opposed relation and in right-angular relation to the pistons P1 and P2. Each dummy piston has an outer flat face 46 engaging the flat face 47 provided within the sleeve 23 and corresponding to the face 39 engaged by the active pistons. Likewise, the dummy piston 44 has an outwardly extended pin 46' which extends into a radially extended notch or slot 48, which corresponds to the notch or slot 41 at the location of the active pistons. Thus, if the pressure in the master piston chambers 36 is equalized, the tool body is centralized in the stabilizer S1, but it is apparent that the tool body can laterally shift within and revolve within the stabilizer sleeve 23 to cause alternate inward movement of the master pistons P1 and P2, as the tool body revolves in the stabilizer, when the stabilizer is engaged with the low side of the bore hole. Inward movement of the pistons applies pressure to fluid in the respective piston chambers.

Referring to FIGS. 4*f* and 15, it will be seen that the slave piston means SP, rotatable within the lower stabilizer S2, comprises a construction very similar to that of the master piston means MP described above. However, in the case of the slave piston means, four pistons P5 through P8 are arranged in circumferentially spaced relation. Here again, the body 11 of the steering tool is provided with four longitudinally extended radial slots 50, arranged in right-angular relation, in each of which is disposed a cylinder block 51 provided with longitudinally spaced cylindrical piston chambers 52, in each of which a piston member 53 is radially reciprocably disposed. The cylinder blocks 51 are retained in place in the slots 50 by means of roll pins or other fastening means 54 which extend chordally through the body and the cylinder block between the longitudinally spaced piston chambers 52. Each piston has a side or piston ring seal 55 slidably and sealingly engaged within the piston chamber 52 and a coiled compression spring 56 normally biases the respective pistons 53 outwardly, so that the outer flat surfaces 56' of the slave pistons are in engagement with the chordally extended flat surfaces 57 provided within the sleeve 23. In addition, each piston 53 has an outwardly extended pin 58 which extends into a circumferentially extended notch or slot 59 within the sleeve 23. The structure is one, as is apparent, which enables relative lateral displacement of the tool body 11 with respect to the stabilizer and sleeve 23, depending upon the force applied by the respective pistons P5 through P8 in a radial direction. This force, as previously indicated, acts on the wall of the bore hole to cause a reaction force tending to urge the bit in a selected direction, in response to rotation of the drill string.

As seen in FIG. 4*f*, to best advantage, each piston block 51 has a fluid passage 60 which establishes fluid communication through passageways, such as the passageway 43*b*, under the control of valve means later to be described, from the master piston means MP. The passage 60 extends into the upper piston chamber 52, through the cylinder block 51 and into the lower piston chamber 52 so that the pistons 53 are coactive.

Referring now to FIGS. 4*a*, 4*b*, 4*c* and 6 through 9, the fluid pressure system between the master and slave piston means will be more fully described. As previously indicated, passages 43*a* and 43*b* extend downwardly through the body 11 from the master piston chambers. As seen in FIGS. 4*b* and 6, these passages 43*a* and 43*b* are provided by tubes or conduits 62 which extend through a bore in a supporting body 63 of elongated form disposed in an elongated slot 64, formed in the tool body 11, the tube support body 63 being retained in place by a retainer strip 65 suitably secured in the groove 64.

In FIG. 4*c*, it will be seen that the passageway 43*a* opens at its lower end into an upper chamber, which is characterized as a valve chamber VC1, defined between a reduced wall section 70 of the tool body 11 and an outer cylindrical sleeve 71 which is suitably mounted upon the larger diameter body section 72 and extends downwardly past a flange 73 on the body to form with the body a lower chamber, characterized as valve chamber VC2. An upper side ring seal 74 forms a seal between the sleeve 71 and the upper enlarged diameter section 72 of the body, and a lower side ring seal 75 forms a seal between the sleeve 71 and the lower enlarged diameter section of the body. The flange 73 also carries a side ring seal 76 forming a seal with the outer sleeve 71, so that the chambers VC1 and VC2 are sealed or separated from one another. Thus, fluid communication between the fluid passage 43*a* and valve chamber VC2 is prohibited. Also, as seen in FIG. 4*c* and in FIG. 6, the tube 62 providing passageway 43*b* extends downwardly through the upper valve chamber VC1, through the flange 73 and communicates with the valve chamber VC2.

It is now apparent that when the upper stabilizer means S1 is resting on the low side of the bore hole, and the drill string P is being rotated, causing rotation of the tool body 11, each revolution of the tool body will cause one of the master pistons P1 and P2 to be shifted inwardly causing the transfer of fluid pressure through respective passages 42*a* and 42*b* to the upper or lower valve chamber VC1 or VC2.

Valve means V, a representative one of which is shown in FIG. 16, and which are also shown in FIG. 8, are provided for establishing communication between the respective valve chambers VC1 and VC2 and a selected one or two of the slave pistons P5 through P8. As seen in FIG. 8 the valve means are designated V5, V6, V7 and V8 corresponding to the respective pistons P5 through P8.

In a manner to be later described, the valves are constructed and actuatable in a manner that permits or prevents communication of the fluid from valve chambers VC1 and VC2, through downward extensions of the fluid passages 43*a* and 43*b*, with selected passages 60 in the cylinder blocks 51 of the slave piston means SP. In FIGS. 9, 10 and 11, it will also be seen that additional passages 43*c* and 43*d* extend downwardly through the tubing structure to the slave piston means. As described above, the downwardly extending passages 43*a* through 43*d* are provided in a structure wherein tubes 62 are extended through support bodies 63 disposed in elongated grooves 64 in the tool body 11, and retained in place by retainer strips 65.

The valves V5 through V8 of the valve means V are represented by the valve V7 shown in FIG. 16. An elongated outer valve sleeve 80 extends longitudinally through the barrier 73 between valve chambers VC1 and VC2. This sleeve 80 has an upper set of radial ports 81 disposed in valve chamber VC1 and a lower set of radial ports 82 disposed in chamber VC2. Reciprocable in the outer stationary valve sleeve 80 is an inner valve sleeve 83 having an upper set of radial ports 84 and a lower set of radial ports 85. A suitable side ring seal 86 is provided above and below each set of ports 84 and 85 for sliding and sealing engagement within the stationary valve sleeve 80. The valve sleeve ports 84 and 85 are relatively closely spaced, but when the valve sleeve 83 is in a center position, as seen in FIG. 16, the valve is fully closed. As indicated by the arrow in FIG. 16, the valve sleeve 83 is adapted for reciprocation, whereby upon upward movement of the valve sleeve 83, ports 81 and 84 may be brought into registry, while upon downward movement of the valve sleeve 83, the ports 85 and 82 will be brought into registry. When the upper valve ports 84 and 81 are in registry, pressure can pass from the upper valve chamber VC1, into the inner valve sleeve 83, the bore through which represents one of the downwardly extended fluid passages, 43*a*, 43*b*, 43*c* or 43*d* leading to the respective slave pistons. On the other hand, when the inner valve sleeve 83 is shifted downwardly, the ports 85 and 82 are in registry, so that pressure from the lower valve chamber VC2 can enter one of the passages 43*a*, 43*b*, 43*c* or 43*d* leading to the respective slave pistons.

Means are provided at longitudinally spaced locations along the assembly to actuate the respective inner valve sleeves 83 between the intermediate or closed condition and either the upper or lower, open positions to selectively establish communication between one of the valve chambers VC1 and VC2 and the respective chambers of slave pistons P5 through P8. These actuators are shown in FIGS. 9, 10, 11 and 12 as actuators AA, AB, AC and AD, respectively. A representative actuator, namely, actuator AA is also shown in FIG. 17, wherein it is also seen that the tube 62 which provides the passageway 43*a* is telescopic in construction. The tube 62 includes an upper section 62*a* fixedly engaged in an elongated rack body 90*a* having a bore 91 therethrough, and a lower tube section 62*b* has its upper end reciprocably disposed in the bore 91 and sealingly and slidably extending through the side ring seal 92. Thus the rack body 90*a* can be shifted upwardly or downwardly relative to the tube section 62*b*, while communication is maintained through the bore 91 between the inner valve sleeve 83 of FIG. 16 and the tube 62 in FIG. 17, so that upward or downward movement of the rack 90*a* can shift the inner valve sleeve longitudinally to close the valve or selectively open the valve and establish communication between either of the valve chambers VC1 or VC2 with one of the slave piston chambers communicating with the passage 43*a*. Since the actuating means shown in FIG. 17 is the actuator for controlling flow to the slave piston P5, it is apparent that if the rack 90*a* is shifted upwardly to establish communication between the valve ports 81 and 84, pressurized fluid from master piston P1 will transfer through the valve chamber VC1 to the slave piston P5, and, conversely, it is apparent that if the rack 90*a* is actuated to shift the inner valve sleeve to a position establishing communication between ports 82 and 85, then pressure can be transferred from the master piston P2 through the lower valve chamber VC2 to the slave piston P5.

As indicated above, a plurality of racks like the rack 90*a* are employed at longitudinally spaced locations for acutation of the several valves V. Referring to FIGS. 9 through 12, racks 90*a*, 90*b*, 90*c* and 90*d*, respectively, are shown incorporated in the longitudinally spaced and angularly displaced actuator means AA, AB, AC and AD. Each rack (as exemplified in FIGS. 4*d* and 10) is reciprocably disposed in a longitudinally extended channel 96 formed in the side of the body and closed by an elongated plate 97 suitably secured in the groove as by fastenings 98. Each pinion 95*a* through 95*d* has a cylindrical body or shaft section 99 rotatably mounted in a bore 100 extending radially in the body from the groove 96. A ring seal 100*a* is provided on each pinion to prevent intrusion of drilling fluid into the actuator mechanism. Ball detent means 101 of the spring loaded type are associated with each rack for engagement with longitudinally spaced indentations in the inner side wall of the respective rack, whereby upon shifting of the rack to position an inner valve sleeve in a selected open or closed position, the rack will be held in the selected position.

It is apparent that when the tool is located at the top of the well bore, the closure plates 97 can be removed, and a suitable tool can be inserted in a non-circular socket 102 formed in the end of each pinion 95*a* to 95*d* to adjust the valves to desired, selected open and closed positions, so that in a manner later to be described fluid pressure will be transferred from the master pistons through one or the other of the valve chambers V1 and V2, depending upon the positioning of the four valves, to selected slave pistons, whereby when the tool is run into the well bore and is being rotated, during drilling, the weight of the drill string, at the low side of the hole, acting on the master pistons will affect lateral force on the drill bit in a desired direction. On the other hand, the tool may be dressed or adjusted at the top of the well bore so that all of the valves are closed, in which case the steering tool is adapted to simply stabilize the drill string in the bore hole to minimize the deviation of the well bore, since there is no pressure transfer from the master pistons to the slave pistons.

As previously indicated, the steering tool is adapted to be manipulated to open or close selected valves of the valve means V, while the steering tool is in the hole by means which are remotely variable. Various devices may be employed for shifting the valve sleeves 62, but in the preferred form herein illustrated, a manipulator tool M is adapted to be run into the drill string, on well known wire line equipment (not shown), and landed in the central bore 150 of the steering tool, through which drilling fluid is normally circulated. As seen in FIG. 4*e* and 13, the manipulator tool has, adjacent the lower end of an elongated housing 151, an orienting slot 152, which, as is well known in the case of wire line well tools, may be formed as a cam engageable with a pin 153 which projects radially inwardly from the body 11 of the steering tool, to engage the cam slot 152 and establish a predetermined angular relationship between the manipulator housing 151 and the steering tool, as seen in FIG. 13. In the present case, the desired orientation of the manipulator tool with respect to the steering tool is such that four longitudinally spaced actuator pinions PA, PB, PC and PD, as seen in FIGS. 9 through 12, respectively, are in radial alignment with the four valve actuator pinions AA, AB, AC, and AD.

Referring to FIGS. 18*a*, 18*b*, 18*c* and 18*d*, the manipulator pinions PA, PB and PC are shown as being mounted in the housing 151 and having an outer end 154 rotatably and slidably disposed within a radial hole 155 in the manipulator housing 151. The inner end of the pinion is formed with a T-head 156 rotatably and slidably disposed in a dove-tail track 157 (see FIG. 19) of an elongated wedge or cam member 158. This wedge member 158 is connected at its upper end by a suitable fastener 159 to a mandrel body section 160, and at its lower end the wedge member 158 is connected by a fastener 161 to a lower mandrel body section 162. Each section of the manipulator mandrel assembly is similarly constructed and comprises mandrel body sections and elongated wedge members innerconnected as an integrated mandrel assembly.

Each wedge member 158 also preferably carries a centralizer plug or member 163 radially shiftably disposed in a hole 164, containing a coiled compression string 165 which acts outwardly on the centralizer member 153 to provide a radial centralizing force against the inner wall of the housing 151, while enabling relative longitudinal movement between the mandrel assembly and the housing. Suitable cross pins extend through a slot 166 in the centralizer member 163 to act as a retainer when the mandrel is not within the tool body 11. Each wedge member 158 is longitudinally shiftably disposed in an elongated radially opening slot 167 formed in the manipulator housing 151, and at the lower end of the slot 167 (see FIG. 18*b*) is a stop shoulder 168 which limits the permitted longitudinal movement of the inner mandrel assembly within the housing 151.

Referring to FIG. 4*e*, the lower end 169 of the inner mandrel assembly engages a coiled compression spring 170, which seats on a seat 171 provided at the junction of the housing 151 with a lower solid body section 172 of the manipulator. Also as seen in FIG. 4*e* and in FIG. 20, the lower end of the manipulator is adapted to be centralized within the tool body 11 by additional centralizer plugs or members 173 which are loaded outwardly by coil springs 174 in spring seats 175, the centralizer members 173 being retained against displacement from the seats 175 by pins 176. It will now be apparent that the inner mandrel assembly which is made up of the plurality of the wedge members 158 and interconnecting body sections 160 and 162 can shift downwardly, against the upward force of the spring 170 when the manipulator has been landed in the steering tool and the weight of the normal wire line sinker bars is applied to the inner mandrel assembly.

Means are provided for rotating the operating pinions PA through PD in opposite directions. As seen in FIG. 19, the manipulator housing 151 is formed with or provided with an inner body section 180 and an opposing inner body section 181, respectively provided with elongated grooves or slots 182 and 183 which receive a pair of opposing racks 184 and 185, the slots being longitudinally extended to permit relative reciprocation of the respective racks 184 and 185, in response to operation of the manipulator tool, as will be later described, whereby to effect rotation of the selected pinion PA, PB, PC or PD. In the illustrated embodiment, the grooves 182 and 183 are formed in chordal body sections 186 which are secured within the manipulator housing 151 as by a suitable number of fasteners 187.

Figure 18C:
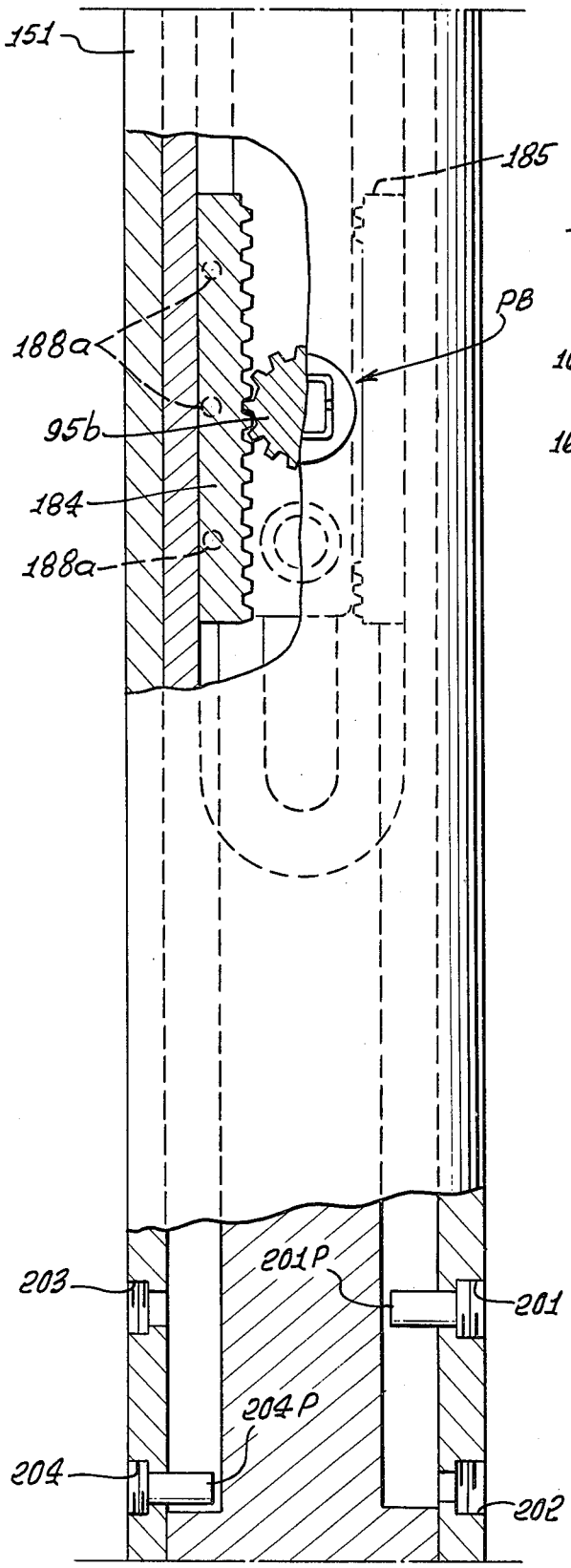
Figure 18D:
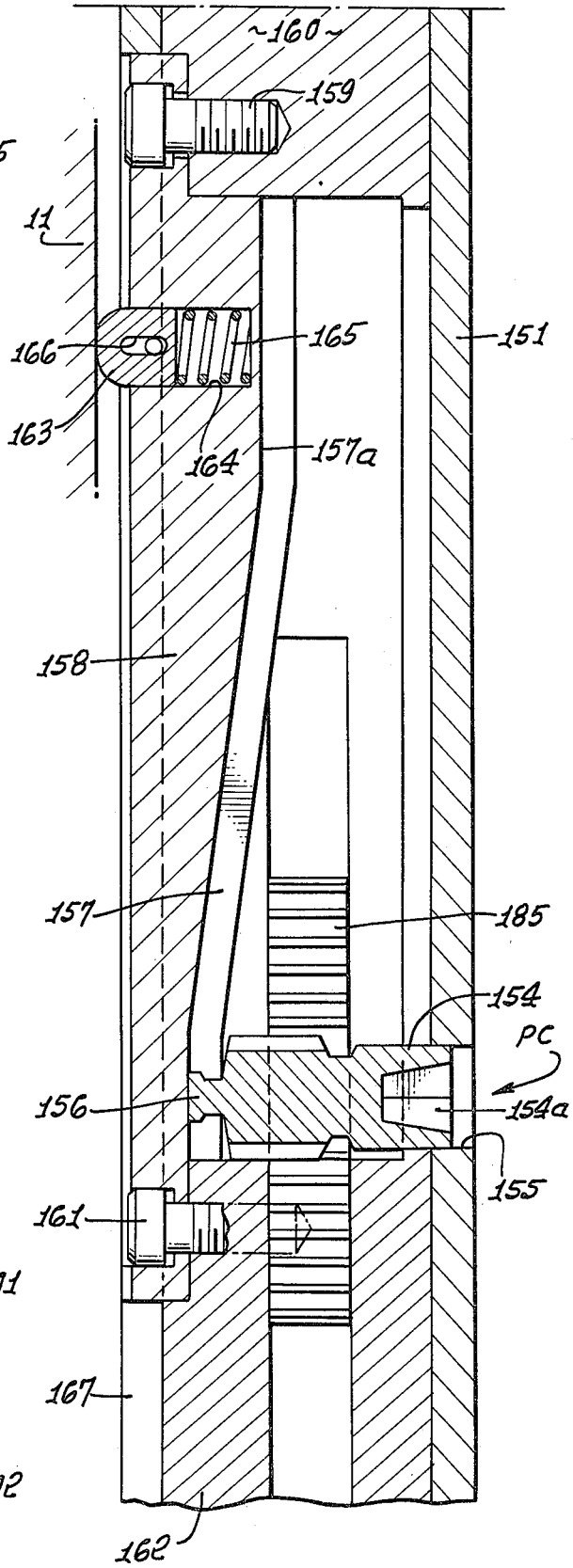

As indicated above, the racks 184 and 185 are adapted to be reciprocated within the grooves 182 and 183, and for the purpose of retaining the respective racks in a selected position within the grooves 182 and 183, ball detent means 188 are provided in the body sections 186. As seen in FIG. 18*c*, the ball detent means 188 includes at least three recesses 188*a* adapted to receive the ball detent and hold the opposing racks 184 and 185 in the neutral condition shown in FIG. 18*c*, at which the racks are opposed to one another and located centrally with respect to the pinion PB, or to hold the racks 184 and 185 in relatively shifted positions. The racks are relatively longitudinally shifted in opposite directions in response to longitudinal movement of one rack and rotation of the intermediate pinion in one direction to shift the other rack longitudinally in the opposite direction.

Means are provided to cause longitudinal relative movement of one of the racks 184 and 185 in its groove 182 or 183, in response to downward movement of the inner mandrel assembly with respect to the outer housing 151 of the manipulator, when the manipulator bottoms in the steering tool. As herein shown, referring to FIG. 18*c*, for example, the outer manipulator body 151 is provided with four threaded openings designated 201, 202, 203 and 204. The openings 201 and 202 are on one side of the housing 151, in alignment below the rack 185, while the threaded openings 203 and 204 are at the diametrically opposite side of the housing 151 aligned beneath the rack 184. These threaded openings are adapted to receive an actuator pin, one of which in FIG. 18*c* is designated 201P. In diametrically downwardly spaced relation to the pin 201 is another pin 204P in the threaded opening 204. Accordingly, upon seating of the manipulator tool, in the steering tool, at which time downward movement of the housing 151 is arrested, the weight of the wireline sinker bars, referred to above, overcomes the counter force of the spring 170 below the inner mandrel body section 169, causing the inner mandrel assembly, and each of the wedges or cam members 158 to move downwardly with respect to the pinions PA through PD, effecting a wedge action by the inclined ramp 158*a*, to cam the respective pinions PA through PD radially outwardly, thereby to effect engagement of the socket 154*a* in the outer end of the respective pinion with a companion drive end 99*a* of the actuator pinions 95*a* through 95*d*. The inner mandrel assembly can continue to move downwardly with respect to the housing 151, following engagement of the pinions 95*a* through 95*d* and PA through PD, when the T-head 156 on the respective pinions PA through PB is engaged in a longitudinally extended section 157*a* of the dovetail slot in the wedge or cam member 158. During the further downward movement of the inner mandrel assembly, again referring to FIG. 18*c*, for example, the rack 185 will abut against the pin 201P, preventing further downward movement of the rack 185 and resultant rotation of the intermediate pinion PB, as the inner mandrel assembly continues to move downwardly, and thereby resulting in the opposing rack 184 being relatively shifted downwardly, until it contacts the pin 204P.

With reference to FIGS. 17 and 18*c*, it will be apparent, under the conditions shown, that the counter clockwise rotation of the pinion PB of FIG. 18*c*, caused by downward movement of the mandrel following engagement of rack 185 with pin 201P, results in counter clockwise rotation of the pinion 95*a* of the actuator AA and downward movement of the valve operating rack 90*a*. This action results in downward movement of the valve conduit 62 a distance sufficient to establish communication between the lower valve chamber VC2 and the interior of the tube 62 through the port 85 in the valve sleeve 62. On the other hand, if the motion is to be reversed, to establish communication between the upper valve chamber VC1, and the interior of the tube 62 through the tube port 84, then an actuator pin can be installed in the drilled hole 203, and the pins 201P and pinion 204P removed, causing the rack 184 to be arrested upon downward movement of the inner mandrel assembly, and causing upward movement of the rack 185 following engagement of the rack 184 with the pin in the recess 203.

From the foregoing, it will be apparent that various combinations of arrangements of the actuator pins in the openings 201 through 204, in the respective valve actuator mechanisms of the manipulator tool, can result in various combinations of the opening or closing of the four valves in the valve means V, so that one or the other of the valve chambers VC1 and VC2 can be connected with a selected one of the slave pistons P5 through P8, whereby the selected slave piston is pressurized in response to pressurization of one of the master pistons during 180° of revolution of the steering tool.

The selected opening and closing of the four valves determines, in the operation of the steering tool, whether the drilling of the bore hole will progress in a mode at which angle is increased, decreased or whether the steering tool is in a straight hole drilling attitude, centralized in the well bore by the stabilizers S1 and S2. The selective opening and closing of the valves also enables the pressurization of a pair of adjacent slave pistons, so that in addition to increasing or decreasing angle, the direction at which angle is being increased or decreased can be changed. On the other hand, the selective opening or closing of the selective valves can force the drill bit in a manner which primarily tends to change the direction in which the drilling progresses, rather than changing angle.

It will be understood from the foregoing and by reference to FIG. 21 that the pressure supplied from master piston chambers P1 and P2, as the steering tool revolves in the bore hole, is transmitted from the respective pistons during rotation and contact with the low side of the hole through approximately 180° of revolution of the tool. Valve chamber VC1 is pressurized by piston P1 and valve chamber VC2 is pressurized by piston P2. Pressure is transmitted to both valve chambers to valves V5, V6, V7 and V8, where under the control of the valve actuators AA, AB, AC and AD, the pressure from either valve chamber can be supplied to the respective slave piston chambers P5, P6, P7 and P8. In FIG. 21, the slave piston means is shown with the directional designations N (north), E (east), S (south), and W (west). With this in mind, it will be understood that in a selected mode of operation, pressure from piston P1 can be transmitted through valve chamber VC1 to the single slave piston P5, resulting in a single pressure pulse per revolution, forcing piston P5 against the bore hole wall, to urge the steering tool and bit in the easterly direction, due to the reaction force. If it is desired that the deflecting force be maintained throughout the entire revolution of the tool, pressure applied to the master piston P2, as it traverses the low side of the bore hole, can be supplied from valve chamber VC2 to the piston chamber P7 of the slave piston means, so that when the tool has been turned 180°, the piston P7 will also provide a force against the hole in the westerly direction, causing a resultant deflecting force to be applied to the tool and bit in the easterly direction. In this latter circumstance, therefore, the bit is subjected to two pressure or force impulses per revolution. It will be also understood that a selected adjacent pair of the slave pistons may be pressurized either once per revolution or twice per revolution, as may be required. In this case, if it is assumed that the north and east pistons are being pressurized against the bore hole, a force will be applied on the bit in a southwesterly direction. On the other hand, if no lateral thrust on the bit is desired, all of the valves V5 through V8 may be in the center position and the stabilizers S1 and S2 simply stabilize the steering tool for straight hole drilling.

It will now be apparent that the present invention provides a steering tool useful in the drilling of directional well bores by the rotary drilling method, wherein the angle and direction can be modified by simply running the pre-set manipulator tool into the well bore, until it lands in the steering tool, whereby the control valves V5 through V8 can be opened or closed, as desired, to establish the desired mode of operation. However, the tool can also be manually set at the top of the hole for establishing the desired drilling attitude.

I claim:

1. A steering tool adapted to control the angle and direction of a rotary well drilling string in the drilling of a well bore through earth formation, said tool comprising: an elongated body having an upper end connectible with the drilling string and a lower end connectible with the drilling string adjacent to the bit, a bore through said body for the flow of drilling fluid through the drilling string and the bit; master piston means adjacent the upper end of said body including a radially shiftable piston inwardly shiftable by engagement of the master piston means with the low side of the well bore wall; slave piston means adjacent the lower end of said body including a plurality of circumferentially spaced radially shiftable pistons for applying lateral thrust on the lower end of said body upon radial outward movement said body having a valve chamber between said master piston means and said slave piston means; fluid passage in said body establishing communication between said valve chamber and each of said slave piston means; and selective valve means in each of said passages between said valve chamber and said slave piston means for establishing fluid pressure communication through said valve chamber between said master piston means and selected passages between said valve chamber and said slave piston means to cause radial outward movement of a selected slave piston upon radial inward movement of said master piston.

2. A steering tool as defined in claim 1; including a stabilizer ring encircling said master piston means and said body for engagement with the well bore wall, and a stabilizer ring encircling said slave piston means and said body for engagement with the well bore wall.

3. A steering tool as defined in claim 1; said selective valve means including actuator means for selectively opening and closing each valve to establish selective communication of said valve chamber with said slave piston means; and remotely variable means for operating said actuator means while said steering tool is in the well bore.

4. A steering tool as defined in claim 1; said selective valve means including actuator means for selectively opening and closing each valve to establish selective communication of said valve chamber with said slave piston means; and a wireline tool having means selectively operable upon said actuator means upon lowering of said wireline tool into said bore in said body to open or close selected valves while said steering tool is in the well bore.

5. A steering tool adapted to control the angle and direction of a rotary well drilling string in the drilling of a well bore through earth formation, said tool comprising: an elongated body having an upper end connectible with the drilling string and a lower end connectible with the drilling string adjacent to the bit, a bore through said body for the flow of drilling fluid through the drilling string and bit; master piston means adjacent the upper end of said body including a radially shiftable piston inwardly shiftable by engagement of the master piston means with the low side of the well bore wall; slave piston means adjacent the lower end of said body including a plurality of circumferentially spaced radially shiftable pistons for applying lateral thrust on the lower end of said body upon radial outward movement; said body having a valve chamber between said master piston means and said slave piston means; fluid passages in said body establishing communication between said valve chamber and said master piston means and between said valve chamber and said slave piston means; and selective valve means for establishing fluid pressure communication through said valve chamber and selected passages to cause radial outward movement of a selected slave piston upon radial inward movement of said master piston; said selective valve means including a valve for each slave piston having a stationary ported sleeve and a ported sleeve longitudinally shiftable relative to said stationary sleeve to establish and interrupt communication between said valve chamber and said slave piston means; and actuator means to shift said longitudinally shiftable sleeve in opposite directions.

6. A steering tool as defined in claim 5; including remotely variable means for operating said actuator means in opposite directions while said steering tool is in the well bore.

7. A steering tool as defined in claim 5; including a wireline tool operable on said actuator means upon lowering of said wireline tool into said bore in said body to shift selected valves in either direction.

8. A steering tool as defined in claim 5; said actuator means including a rack on said longitudinally shiftable sleeve and a pinion rotatable in said body and engaged with said rack; said pinion having a shaft exposed externally of said body for engagement with a driving tool.

9. A steering tool as defined in claim 5; said actuator means including a rack on said longitudinally shiftable sleeve and a pinion rotatable in said body and engaged with said rack; said pinion having a shaft exposed externally of said body for engagement with a driving tool; said pinion also having said shaft exposed in the bore through said body for engagement by a driver.

10. A steering tool as defined in claim 5; said actuator means including a rack on said longitudinally shiftable sleeve and a pinion rotatable in said body and engaged with said rack; said pinion having a shaft exposed externally of said body for engagement with a driving tool; said pinion also having said shaft exposed in the bore through said body for engagement by a driver; and including a wireline manipulator tool having a driver operable upon lowering of said manipulator tool into the bore in said body to engage said shaft and rotate said shaft in a selected direction.

11. A steering tool as defined in claim 5; said actuator means including a rack on said longitudinally shiftable sleeve and a pinion rotatable in said body and engaged with said rack; said pinion having a shaft exposed externally of said body for engagement with a driving tool; said pinion also having said shaft exposed in the bore through said body for engagement by a driver; and including a wireline manipulator tool having a driver operable upon lowering of said manipulator tool into the bore in said body to engage said shaft and rotate said shaft in a selected direction; said manipulator tool including an elongated housing adapted to be seated in said bore in said housing; a mandrel longitudinally shiftable in said housing when said housing is seated; said driver being a radially shiftable operating pinion rotatable in said housing; cam means for shifting said operating pinion radially into engagement with the valve actuator pinion shaft upon longitudinal movement of said mandrel in said housing; opposed racks engaged with said operating pinion and oppositely longitudinally shiftable in said housing; and selective means on said mandrel to engage and shift one of said opposed racks upon movement of said mandrrel in said housing to rotate said operating pinion in a selected direction.

12. A steering tool as defined in claim 5; said actuator means including a rack on said longitudinally shiftable sleeve and a pinion rotatable in said body and engaged with said rack; said pinion having a shaft exposed externally of said body for engagement with a driving tool; said pinion also having said shaft exposed in the bore through said body for engagement by a driver; and including a wireline manipulator tool having a driver operable upon lowering of said manipulator tool into the bore in said body to engage said shaft and rotate said shaft in a selected direction; said manipulator tool including an elongated housing adapted to be seated in said bore in said housing; a mandrel longitudinally shiftable in said housing when said housing is seated; said driver being a radially shiftable operating pinion rotatable in said housing; cam means for shifting said operating pinion radially into engagement with the valve actuator pinion shaft upon longitudinal movement of said mandrel in said housing; opposed racks engaged with said operating pinion and oppositely longitudinally shiftable in said housing; and selective means on said mandrel to engage and shift one of said opposed racks upon movement of said mandrel in said housing to rotate said operating pinion in a selected direction; said actuator pinions and said operating pinions being correspondingly longitudinally and angularly spaced in said body and said manipulator housing to mate when said housing is in said body; said body and said housing having cooperative means for orienting said housing in said body to align the angularly spaced actuator and operating pinions.

13. A steering tool adapted to control the angle and direction of a rotary well drilling string in the drilling of a well bore through earth formation, said tool comprising: an elongated body having an upper end connectible with the drilling string and a lower end connectible in the drilling string adjacent to the bit; a bore through said body for the flow of drilling fluid through the drilling string and bit; master piston means adjacent the upper end of said body including at least a pair of diametrically spaced piston chambers having radially shiftable pistons alternately inwardly shiftable by engagement of the master piston means with the low side of the well bore wall; slave piston means adjacent the lower end of said body including at least a pair of diametrically spaced piston chambers having radially shiftable pistons for applying lateral thrust on the lower end of the body upon radial outward movement; said body having a pair of separate upper and lower valve chambers between said master piston means and said slave piston means; a first fluid passage communicating with said upper valve chamber and one of said master piston chambers; a second fluid passage communicating with said lower valve chamber and the other master piston chamber; fluid passages communicating between both of said valve chambers and each of said slave piston chambers; selective valve means operable for opening and closing said latter fluid passages; and actuator means for opening and closing said valve means for establishing or interrupting fluid communication between a selected valve chamber and selected slave piston chambers to cause radial outward movement of selected slave pistons upon radial inward movement of said master pistons.

14. A steering tool as defined in claim 13; including a stabilizer ring encircling said master piston means and said body for engagement with the well bore wall, and a stabilizer ring encircling said slave piston means and said body for engagement with the well bore wall.

15. A steering tool as defined in claim 13; and including remotely variable means for operating said actuator means while said steering tool is in the well bore.

16. A steering tool as defined in claim 13; and including a wireline tool having means selectively operable upon said actuator means upon lowering of said wireline tool into said bore in said body to open and close selected valves while said steering tool is in the well bore.

17. A steering tool as defined in claim 13; said selective valve means including a valve for each slave piston having a stationary valve member provided with ports communicating with the respective valve chambers and a ported member shiftable in opposite directions relative to said stationary member to establish and interrupt communication between either of said valve chambers and one of said slave piston chambers; and actuator means to shift said shiftable valve member in opposite directions.

18. A steering tool as defined in claim 17; including remotely variable means for operating said actuator means in opposite directions while said steering tool is in the well bore.

19. A steering tool as defined in claim 17; including a wireline tool operable on said actuator means upon lowering of said wireline tool into said bore in said body to shift selected valve sleeves in opposite directions.

20. A steering tool as defined in claim 17; said actuator means including a driven gear on said shiftable member and a drive gear rotatable in said body and engaged with said drive gear; said pinion having a shaft exposed externally of said body for engagement by a driving tool.

21. A steering tool as defined in claim 17; said actuator means including a rack on said shiftable member and a pinion rotatable in said body and engaged with said rack; said pinion having a shaft exposed externally of said body for engagement by a driving tool; said pinion also having said shaft exposed in the bore through said body for engagement by a driver.

22. A steering tool as defined in claim 17; said actuator means including a rack on said shiftable member and a pinion rotatable in said body and engaged with said rack; said pinion having a shaft exposed externally of said body for engagement by a driving tool; said pinion also having said shaft exposed in the bore through said body for engagement by a driver; and including a wireline manipulator tool having a driver operable upon lowering of said manipulator tool into the bore in said body to engage a shaft and rotate a selected shaft in a selected direction.

23. A steering tool as defined in claim 17; said actuator means including a rack on said shiftable member and a pinion rotatable in said body and engaged with said rack; said pinion having a shaft exposed externally of said body for engagement by a driving tool; said pinion also having said shaft exposed in the bore through said body for engagement by a driver; and including a wireline manipulator tool having a driver operable upon lowering of said manipulator tool into the bore in said body to engage a shaft and rotate a selected shaft in a selected direction; said manipulator tool including an elongated housing adapted to be seated in said bore in said body; a mandrel longitudinally shiftable in said housing when said housing is seated; said driver being a radially shiftable operating pinion rotatable in said housing; cam means for shifting said operating pinion into engagement with the valve actuator pinion shaft upon longitudinal movement of said mandril in said housing; opposed racks engaged with said operating pinion and oppositely longitudinally shiftable in said housing; and selective means on said mandrel to engage and shift one of said opposed racks upon movement of said mandrel in said housing to rotate said operating pinion in a selected direction.

24. A steering tool as defined in claim 17; said actuator means including a driven gear on said shiftable member and a drive gear rotatable in said body and engaged with said driven gear; said drive gear having a shaft exposed externally of said body for engagement by a driving tool; said drive gear also having said shaft exposed in the bore through said body for engagement by a driver; and including a wireline manipulator tool operable upon lowering of said manipulator tool into the bore in said body to engage a shaft and rotate a selected shaft in a selected direction; said manipulator tool including an elongated housing adapted to be seated in said bore in said body; a mandrel longitudinally shiftable in said housing when said housing is seated; a radially shiftable operating pinion rotatable in said housing; cam means for shifting said operating pinion into engagement with the valve actuator gear shaft upon longitudinal movement of said mandrel in said housing; opposed racks engaged with said operating pinion and oppositely longitudinally shiftable in said housing; and selective means on said mandrel to engage and shift one of said opposed racks upon movement of said mandrel in said housing to rotate said operating pinion in a selected direction; said actuator gear shafts and said operating pinions being correspondingly longitudinally and angularly spaced in said body and manipulator housing to mate when said housing is in said body; said body and said housing having cooperative means for orienting said housing in said body to align the angularly spaced actuator gear shafts and operating pinions.

25. A steering tool adapted to control the angle and direction of rotary well drilling string in the drilling of a well bore through earth formation, said tool comprising; an elongated body having an upper end connectible with the drilling string and a lower end connectible in the drilling string adjacent to the bit; a bore through said body for the flow of drilling fluid through the drilling string and bit; said body having separate upper and lower pressure chambers; therein; master piston means adjacent the upper end of said body including a pair of radial piston chambers in diametrically spaced relation and a piston in each piston chamber; a first fluid passage between the upper pressure chamber and one piston chamber; a second fluid passage between the lower pressure chamber and the other piston chamber; slave piston means adjacent the lower end of said body including a plurality of circumferentially spaced radial piston chambers and a piston in each piston chamber; a passage between each slave piston chamber and each of said upper and lower pressure chambers; valve means to open and close said passage between each slave piston chamber and pressure chamber; and means for selectively actuating said valve means to selectively establish and interrupt pressure transfer from said master piston chambers through said pressure chambers and selected slave piston chambers.

26. A steering tool as defined in claim 25; including remotely adjustable means operable on said actuating means for said valve means to open and close said valve means selectively while said tool remains in the well bore.

27. A steering tool as defined in claim 25; including a wireline tool having means selectively operable upon said actuating means for said valve means to open and close said valve means while said steering tool remains in the well bore.

* * * * *